US012790904B2

(12) United States Patent
Alanqari et al.

(10) Patent No.: US 12,790,904 B2
(45) Date of Patent: Nov. 10, 2026

(54) REMEDYING LOST CIRCULATION

(71) Applicant: Saudi Arabian Oil Company, Dhahran (SA)

(72) Inventors: Khawlah Alanqari, Alkhobar (SA); Abdullah Saleh Hussain Al-Yami, Dhahran (SA); Abdulaziz Alhehal, Al Ahsa (SA); Vikrant Bhavanishankar Wagle, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/010,674

(22) Filed: Jan. 6, 2025

(65) Prior Publication Data

US 2026/0193946 A1 Jul. 9, 2026

(51) Int. Cl.
*E21B 43/34* (2006.01)
*E21B 21/00* (2006.01)

(52) U.S. Cl.
CPC ..... *E21B 21/003* (2013.01)

(58) Field of Classification Search
CPC ..... C09K 8/467; E21B 43/34; E21B 43/13
USPC ..... 166/293
See application file for complete search history.

(56) References Cited

U.S. PATENT DOCUMENTS 3,625,287 A 12/1971 Young
4,547,298 A 10/1985 Novak
5,911,282 A 6/1999 Onan et al.
6,448,206 B1 9/2002 Griffith et al.
7,488,705 B2 * 2/2009 Reddy ..... C09K 8/508 507/119
7,723,273 B1 * 5/2010 Zaid ..... C08G 59/504 507/239
7,794,537 B2 9/2010 Barlet-Gouedard et al.
7,846,250 B2 12/2010 Barlet-Gouedard et al.
8,157,009 B2 4/2012 Patil et al.
9,222,010 B2 12/2015 Porcherie et al.
9,321,687 B2 4/2016 Gupta et al.
9,394,202 B2 7/2016 Porcherie et al.
9,410,066 B2 8/2016 Ghassemzadeh
9,701,885 B2 7/2017 Husein et al.
9,828,293 B2 11/2017 Yadav et al.
(Continued)

FOREIGN PATENT DOCUMENTS

CN 113248792 B 4/2022
WO WO 2016043979 A1 3/2016
(Continued)

OTHER PUBLICATIONS

U.S. Appl. No. 18/480,888, filed Oct. 4, 2023, Al Safran et al.
(Continued)

*Primary Examiner* — William D Hutton, Jr.
*Assistant Examiner* — Ashish K Varma
(74) *Attorney, Agent, or Firm* — Fish & Richardson P.C.

(57) ABSTRACT

A lost circulation composition is flowed to a lost circulation zone within a wellbore formed in a subterranean formation. The lost circulation composition includes volcanic ash, an epoxy resin, and a curing agent. The curing agent includes nitrogen. The curing agent crosslinks the epoxy resin to form a plug at the lost circulation zone. The plug prevents fluid from flowing from the wellbore into the subterranean formation through the plug at the lost circulation zone.

17 Claims, 3 Drawing Sheets

(56) References Cited

U.S. PATENT DOCUMENTS

| | | | | |
|---|---|---|---|---|
| 9,890,082 | B2 | 2/2018 | Dubey | |
| 10,005,930 | B2 * | 6/2018 | Reddy | C08G 59/504 |
| 10,017,418 | B2 | 7/2018 | Thomas et al. | |
| 10,081,755 | B2 | 9/2018 | Ballard | |
| 10,112,869 | B2 | 10/2018 | Agapiou | |
| 10,113,389 | B2 | 10/2018 | Pandey et al. | |
| 10,138,405 | B2 | 11/2018 | Kulkarni et al. | |
| 10,144,858 | B2 | 12/2018 | Kennedy et al. | |
| 10,767,100 | B2 * | 9/2020 | Gamwell | C04B 28/02 |
| 10,920,121 | B1 | 2/2021 | Alanqari et al. | |
| 11,066,899 | B1 * | 7/2021 | Alanqari | E21B 21/003 |
| 11,472,741 | B2 | 10/2022 | Sampson | |
| 11,624,020 | B1 | 4/2023 | Alanqari et al. | |
| 2006/0041060 | A1 | 2/2006 | George | |
| 2007/0125272 | A1 | 6/2007 | Johnson | |
| 2009/0200029 | A1 | 8/2009 | Roddy et al. | |
| 2017/0002257 | A1 | 1/2017 | Pisklak | |
| 2018/0215988 | A1 | 8/2018 | Gamwell | |
| 2020/0071593 | A1 | 3/2020 | Al-Yami et al. | |
| 2020/0131425 | A1 | 4/2020 | Alsaihati | |
| 2022/0073807 | A1 | 3/2022 | Wagle et al. | |

FOREIGN PATENT DOCUMENTS

| | | | |
|---|---|---|---|
| WO | WO 2017180796 | A1 | 10/2017 |
| WO | WO 2020086304 | A1 | 4/2020 |
| WO | WO 2021188154 | A1 | 9/2021 |
| WO | WO 2024092303 | A1 | 5/2024 |

OTHER PUBLICATIONS

[No Author Listed], "Standard Test Method for Epoxy Content of Epoxy Resins," ASTM-D1652-11, 2019, 2 pages.

Alanqari et al., "Synthesis of Epoxy Resin Based Geopolymer Utilizing Saudi Arabian Volcanic Ash for Primary Well Cementing Applications," Prepared for Presentation at the ADIPEC held in Abu Dhabi, UAE, Oct. 31-Nov. 3, 2022, 7 pages.

Al-Yami et al., "Chemical Additives for Oil Well Cementing," Research & Reviews: Journal of Chemistry, Oct. 20, 2017, 6(4):1-14, 14 pages.

Kumar et al., "Evaluation of Flexural Strength of Epoxy Polymer Concrete with Red Mud and Fly Ash," International Journal of Current Engineering and Technology, Dec. 2013, 3(5):1799-1803, 5 pages.

Maherzi et al., "Study of the polymer mortar based on dredged sediments and epoxy resin: Effect of the sediments on the behavior of the polymer mortar," Powder Technology, 2020, 361:968-982, 15 pages.

Red Mud Production, Composition and Impact, Richard (ed.), 2018, 327 pages.

Yang et al., "Recent advances of thermosetting resin and its application prospect in oil and gas drilling and production engineering," Geoenergy Science and Engineering, 2023, 230(212222):1-29, 29 pages.

U.S. Appl. No. 19/010,845, filed Jan. 6, 2025, Alanqari et al.

International Search Report and Written Opinion in Intl. Appln. No. PCT/US2026/010250, mailed on Mar. 19, 2026, 14 pages.

International Search Report and Written Opinion in Intl. Appln. No. PCT/US2026/010249, mailed on Mar. 23, 2026, 11 pages.

* cited by examiner

REMEDYING LOST CIRCULATION

TECHNICAL FIELD

This disclosure relates to remedying lost circulation in subterranean formations.

BACKGROUND

In oil or gas well drilling, lost circulation is an undesirable situation in which drilling fluid, also known as mud, flows into a subterranean formation instead of returning up to the surface. In partial lost circulation, mud continues to flow to the surface with some loss of mud to the formation. In total lost circulation, all of the mud flows into the formation with no return to the surface. The consequences of lost circulation can range from a loss of drilling fluid to blowout or even loss of life. Prevention of lost circulation is desirable, but because lost circulation is such a common occurrence, remediation methods can help mitigate lost circulation when it has occurred.

SUMMARY

This disclosure describes technologies relating to remedying lost circulation in subterranean formations. The subject matter described in this disclosure can be implemented in particular implementations, so as to realize one or more of the following advantages. The compositions, methods, and systems described can be used to isolate a lost circulation zone of a wellbore. Once cured, the LCM composition including the epoxy resin forms a barrier that prevents drilling fluids (having a pressure greater than the formation pressure) from flowing out of the wellbore and into the formation. Volcanic ash, which is typically considered a waste material, can be incorporated into the compositions described to improve viscosity of the LCM composition. Thus, the compositions, methods, and systems described can support sustainability of oil and gas operations by reusing and incorporating waste materials, such as volcanic ash, in performing useful operations, such as mitigating/remedying lost circulations in wells while drilling.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure describes remedying lost circulation using a composition including an epoxy resin, a crosslinker (also referred to as a curing agent), and volcanic ash (which is typically a waste material). The volcanic ash facilitates generation of a hard gel that becomes rigid downhole for remedying moderate to severe lost circulation in wells. In some cases, the composition includes an emulsifier for improved mixing. Weighting materials can also be included in the composition. The crosslinker increases viscosity of the composition. Setting time of the composition to form the hard gel can be controlled by varying the type of resin and/or the type of crosslinker. Setting time of the composition to form the hard gel can be controlled by varying the concentration of crosslinker in the composition.

Extracting subterranean hydrocarbons sources may require drilling a hole from the surface to the subterranean geological formation housing the hydrocarbons. Specialized drilling techniques and materials are utilized to form the bore hole and extract the hydrocarbons. Specialized materials utilized in drilling operations include materials for sealing the casing-casing annulus of the wellbore, which may be formulated for specific downhole conditions. A wellbore is a hole that extends from the surface to a location below the surface to permit access to hydrocarbon-bearing subterranean formations. The wellbore contains at least a portion of a fluid conduit that links the interior of the wellbore to the surface. The fluid conduit connecting the interior of the wellbore to the surface may be capable of permitting regulated fluid flow from the interior of the wellbore to the surface and may permit access between equipment on the surface and the interior of the wellbore. The fluid conduit may be defined by one or more tubular strings, such as casings for example, inserted into the wellbore and secured in the wellbore.

During drilling of a wellbore, cementing the wellbore, or both, lost circulation zones may be encountered and may result in loss of drilling fluid or cementing compositions. In a lost circulation zone, the drilling fluid or cement composition flows out of the wellbore and into the surrounding formation. Lost circulation zones may result in increased cost of the well through increased material costs to replace lost fluids and downtime to remediate the lost circulation zone. Lost circulation zones may be remediated by introducing a lost circulation material into the lost circulation zone to seal off the lost circulation zone to prevent further fluid loss. Conventional lost circulation materials (LCM) can include bridging material, fibrous material, flaky material, cement such as reduced-cure-time cement, and other materials having different particle sizes. While these materials may be effective at mediating many lost circulation zones, these conventional materials are not effective for use as LCM in big-injectivity zones.

Figure 1:
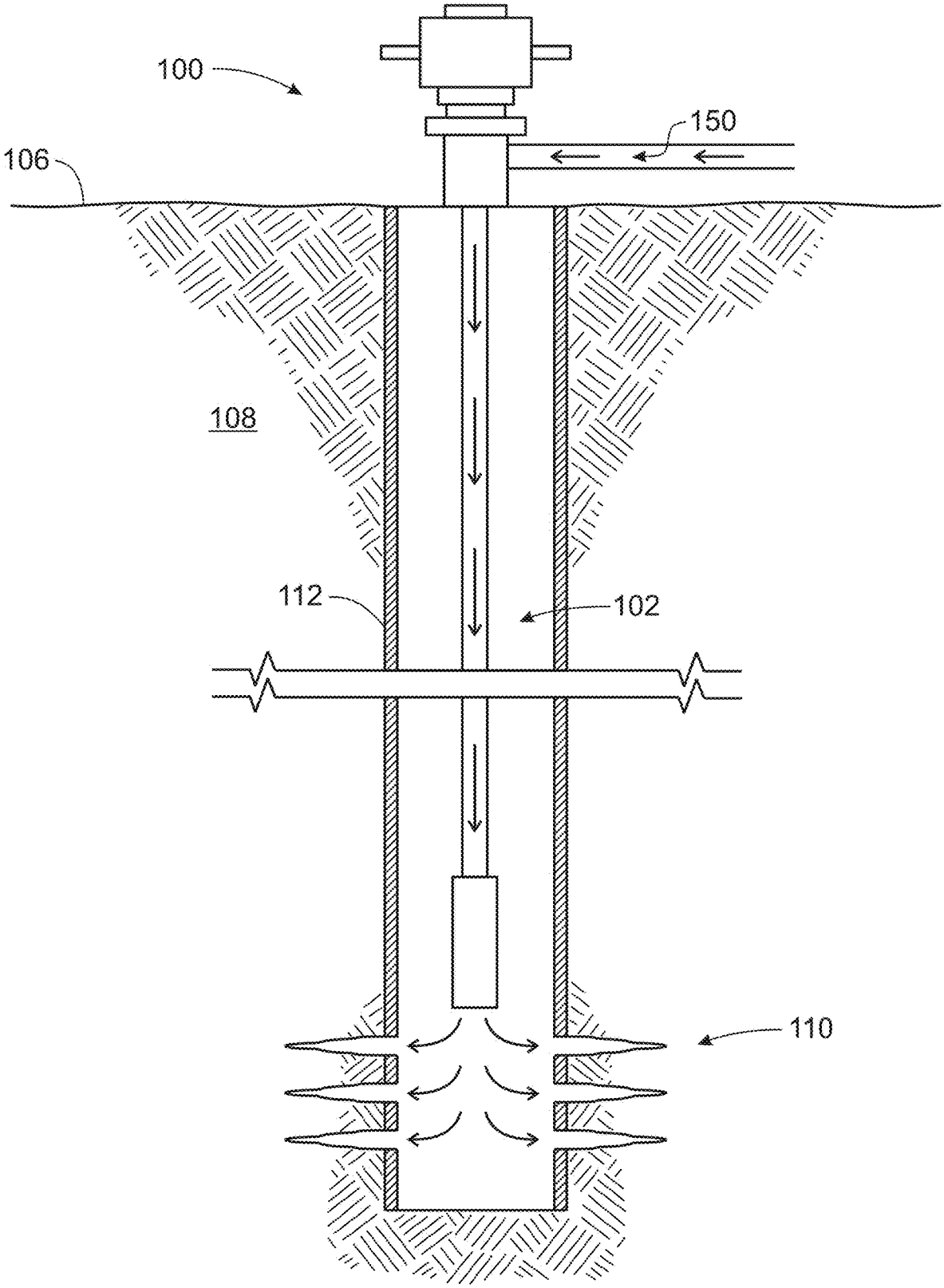
FIG. 1 is a schematic diagram of an example well.

FIG. 1 depicts an example well 100 constructed in accordance with the concepts herein. The well 100 includes a wellbore 102 that extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other types of formations, including reservoirs that are not naturally fractured. For simplicity's sake, the well 100 is shown as a vertical well, but in other instances, the well 100 can be a deviated well with a wellbore 102 deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

During drilling of the well 100, operators may encounter a lost circulation scenario. In such cases, it may be necessary to halt drilling and mitigate the lost circulation. Mitigating and/or remedying the lost circulation in the well 100 can include flowing a lost circulation composition 150 into the well 100. The lost circulation composition 150 can be placed in a desired location within the well 100 (for example, the location of lost circulation) and form a seal to prevent fluid from flowing from the wellbore 102 and into the subterranean formation, thereby mitigating and/or remedying the lost circulation. Thermal modeling can be implemented to determine the optimal location for delivering the lost circulation composition 150. For example, the desired location within the well 100 can be at the location of lost circulation (sometimes referred to as loss zone) or directly up hole of that location. Once the lost circulation composition 150 is placed in the desired location within the well 100, the lost circulation composition 150 can be cured (for example, crosslinked) in response to exposure to downhole condition(s) at the loss zone (for example, downhole temperatures in a range of from about 20 degrees Celsius (° C.) to about 205° C.). Curing the lost circulation composition 150 causes the lost circulation composition 150 to solidify, thereby forming a plug 150'. The plug 150' forms a seal at the loss zone and prevents fluid from flowing from the wellbore into the subterranean formation, thereby remedying the lost circulation in the well 100.

The composition 150 includes volcanic ash, an epoxy resin, and a curing agent. In some implementations, the composition 150 includes an emulsifier. Volcanic ash can increase viscosity of the composition 150 and can also function as a weighting material. Volcanic ash can include, for example, sulfur trioxide ($SO_3$), calcium oxide (CaO), silicon dioxide ($SiO_2$), aluminum oxide ($Al_2O_3$), iron(III) oxide ($Fe_2O_3$), magnesium oxide (MgO), and potassium oxide ($K_2O$).

The compositions of the present disclosure include volcanic ash. In some implementations, the composition 150 includes about 0.01 weight percent (wt. %) to about 50 wt. %, about 1.0 wt. % to about 40 wt. %, about 2.0 wt. % to about 30 wt. %, about 3.0 wt. % to about 20 wt. %, about 4.0 wt. % to about 10 wt. %, or about 5.0 wt. % to about 8.0 wt. % volcanic ash. In some implementations, the composition 150 includes about 0.01 wt. % to about 50 wt. % volcanic ash. In some implementations, the composition 150 includes about 1.0 wt. % to about 40 wt. % volcanic ash. In some implementations, the composition 150 includes about 2.0 wt. % to about 30 wt. % volcanic ash. In some implementations, the composition 150 includes about 3.0 wt. % to about 20 wt. % volcanic ash. In some implementations, the composition 150 includes about 4.0 wt. % to about 10 wt. % volcanic ash. In some implementations, the composition 150 includes about 5.0 wt. % to about 8.0 wt. % volcanic ash.

In some implementations, the composition 150 includes about 0.01 wt. % to about 50 wt. %, about 0.01 wt. % to about 25 wt. %, about 0.01 wt. % to about 15 wt. %, about 0.01 wt. % to about 10 wt. %, or about 0.01 wt. % to about 5 wt. % volcanic ash. In some implementations, the composition 150 includes about 0.01 wt. % to about 50 wt. % volcanic ash. In some implementations, the composition 150 includes about 0.01 wt. % to about 25 wt. % volcanic ash. In some implementations, the composition 150 includes about 0.01 wt. % to about 15 wt. % volcanic ash. In some implementations, the composition 150 includes about 0.01 wt. % to about 10 wt. % volcanic ash. In some implementations, the composition 150 includes about 0.01 wt. % to about 5 wt. % volcanic ash.

In some implementations, the composition 150 includes about 0.1 wt. % to about 25 wt. %, about 1 wt. % to about 20 wt. %, about 5 wt. % to about 15 wt. %, or about 6 wt. % to about 14 wt. %. volcanic ash. In some implementations, the composition 150 includes about 0.1 wt. % to about 25 wt. % volcanic ash. In some implementations, the composition 150 includes about 1 wt. % to about 20 wt. % volcanic ash. In some implementations, the composition 150 includes about 5 wt. % to about 15 wt. % volcanic ash. In some implementations, the composition 150 includes about 6 wt. % to about 14 wt. % volcanic ash.

In some implementations, the composition 150 includes about 6 wt. % to about 20 wt. %, about 6.5 wt. % to about 18 wt. %, about 7 wt. % to about 16 wt. %, about 7.5 wt. % to about 15 wt. %, or about 8 wt. % to about 14 wt. % volcanic ash. In some implementations, the composition 150 includes about 6 wt. % to about 20 wt. % volcanic ash. In some implementations, the composition 150 includes about 6.5 wt. % to about 18 wt. % volcanic ash. In some implementations, the composition 150 includes about 7 wt. % to about 16 wt. % volcanic ash. In some implementations, the composition 150 includes about 7.5 wt. % to about 15 wt. % volcanic ash. In some implementations, the composition 150 includes about 8 wt. % to about 14 wt. % volcanic ash.

In some implementations, about 50% of the volcanic ash particles have a diameter of about 50 μmicrometers (m) or less. In some implementations, about 60% of the volcanic ash particles have a diameter of about 50 μm or less. In some implementations, about 70% of the volcanic ash particles have a diameter of about 50 μm or less. In some implementations, about 80% of the volcanic ash particles have a diameter of about 50 μm or less. In some implementations, about 90% of the volcanic ash particles have a diameter of about 50 μm or less.

In some implementations, the volcanic ash particles are about 10 μm to about 100 m, about 20 μm to about 90 μm, about 30 μm to about 80 μm, about 40 μm to about 70 am, or about 50 μm to about 60 μm in diameter. In some implementations, the volcanic ash particles are about 10 μm to about 100 am in diameter. In some implementations, the volcanic ash particles are about 20 μm to about 90 μm in diameter. In some implementations, the volcanic ash particles are about 30 μm to about 80 μm in diameter. In some implementations, the volcanic ash particles are about 40 μm to about 70 μm in diameter. In some implementations, the volcanic ash particles are about 50 μm to about 60 μm in diameter.

In some implementations, the volcanic ash particles are about 10 am in diameter. In some implementations, the volcanic ash particles about 20 am in diameter. In some implementations, the volcanic ash particle size is about 30 μm in diameter. In some implementations, the volcanic ash particle size is about 40 μm in diameter. In some implementations, the volcanic ash particle size is about 50 μm in diameter. In some implementations, the volcanic ash particle size is about 60 μm in diameter. In some implementations, the volcanic ash particle size is about 70 μm in diameter. In some implementations, the volcanic ash particle size is about 80 μm in diameter. In some implementations, the volcanic ash particle size is about 90 μm. In some implementations, the volcanic ash particle size is about 100 μm in diameter.

In some implementations, about 80% of the volcanic ash particles have a diameter of about 10 μm or less. In some implementations, about 80% of the volcanic ash particles have a diameter of about 20 μm or less. In some implementations, about 80% of the volcanic ash particles have a diameter of about 30 μm or less. In some implementations, about 80% of the volcanic ash particles have a diameter of about 40 μm or less. In some implementations, about 80% of the volcanic ash particles have a diameter of about 50 μm or less. In some implementations, about 80% of the volcanic ash particles have a diameter of about 60 μm or less. In some implementations, about 80% of the volcanic ash particles have a diameter of about 70 μm or less. In some implementations, about 80% of the volcanic ash particles have a diameter of about 80 μm or less. In some implementations, about 80% of the volcanic ash particles have a diameter of about 90 μm or less. In some implementations, about 80% of the volcanic ash particles have a diameter of about 100 μm or less.

In some implementations, the volcanic ash includes a plurality of oxides. In some implementations, the volcanic ash includes calcium oxide (CaO), silicon dioxide ($SiO_2$), aluminum oxide ($Al_2O_3$), iron III oxide ($Fe_2O_3$), magnesium oxide (MgO), potassium oxide ($K_2O$), and combinations thereof. In some implementations, the volcanic ash includes a plurality of oxides. In some implementations, the volcanic ash includes calcium oxide (CaO), silicon dioxide ($SiO_2$), aluminum oxide ($Al_2O_3$), iron III oxide ($Fe_2O_3$), magnesium oxide (MgO), and potassium oxide ($K_2O$). In some implementations, the volcanic ash includes calcium oxide (CaO). In some implementations, the volcanic ash includes silicon dioxide ($SiO_2$). In some implementations, the volcanic ash includes aluminum oxide ($Al_2O_3$). In some implementations, the volcanic ash includes iron III oxide ($Fe_2O_3$). In some implementations, the volcanic ash includes magnesium oxide (MgO). In some implementations, the volcanic ash includes potassium oxide ($K_2O$).

In some implementations, the volcanic ash includes oxygen (O), sodium (Na), iron (Fe), aluminum (Al), silicon (Si), calcium (Ca), titanium (Ti), sulfur (S), fluorine (F), chlorine (Cl), strontium (Sr), zirconium (Zr), phosphorus (P), magnesium (Mg), chromium (Cr), and combinations thereof. In some implementations, the volcanic ash includes oxygen (O), sodium (Na), titanium (Ti), sulfur (S), fluorine (F), chlorine (Cl), strontium (Sr), zirconium (Zr), phosphorus (P), magnesium (Mg), and chromium (Cr). In some implementations, the volcanic ash includes oxygen (O).

In some implementations, the volcanic ash includes sodium (Na). In some implementations, the volcanic ash includes iron (Fe). In some implementations, the volcanic ash includes aluminum (Al). In some implementations, the volcanic ash includes silicon (Si). In some implementations, the volcanic ash includes calcium (Ca). In some implementations, the volcanic ash includes titanium (Ti). In some implementations, the volcanic ash includes sulfur (S). In some implementations, the volcanic ash includes fluorine (F). In some implementations, the volcanic ash includes chlorine (Cl). In some implementations, the volcanic ash includes strontium (Sr). In some implementations, the volcanic ash includes zirconium (Zr). In some implementations, the volcanic ash includes phosphorus (P). In some implementations, the volcanic ash includes magnesium (Mg). In some implementations, the volcanic ash includes chromium (Cr).

The composition 150 can include a single type of epoxy resin or multiple types of epoxy resins mixed together. The type(s) of epoxy resin and the concentration of the epoxy resin(s) in the composition 150 may affect the viscosity of the composition 150 before setting. The epoxy resin(s) may have a viscosity that enables the composition 150 to be transferred into an annulus between the exterior surface of the tubular string and the wellbore wall or the interior surface of a casing surrounding the tubular string. In some implementations, the epoxy resin(s) has/have a viscosity that enables introduction of the composition 150 having the epoxy resin(s) into a wellbore. In some implementations, the composition 150 includes about 20 wt. % to about 99 wt. %, about 30 wt. % to about 99 wt. %, about 50 wt. % to about 95 wt. %, about 70 wt. % to about 92 wt. %, or about 80 wt. % to about 90 wt. % epoxy resin(s). In some implementations, the composition 150 includes about 30 wt. % to about 99 wt. % epoxy resin(s). In some implementations, the composition 150 includes about 50 wt. % to about 95 wt. % epoxy resin(s). In some implementations, the composition 150 includes about 70 wt. % to about 92 wt. % epoxy resin(s). In some implementations, the composition 150 includes about 80 wt. % to about 90 wt. % epoxy resin(s).

The curing agent is an amine-type curing agent that includes nitrogen. Curing time of the composition 150 to form the plug 150' can be controlled, for example, by adjusting the type of curing agent, adjusting the concentration of the curing agent in the composition 150, or both. In some implementations, the composition 150 includes a weighting material, such as barite or manganese tetraoxide ($Mn_3O_4$).

In some implementations, the composition 150 includes from 50 weight percent (wt. %) to 97 wt. % epoxy resin. The epoxy resin can include at least one of 2,3-epoxypropyl o-tolyl ether, alkyl glycidyl ethers having from 12 to 14 carbon atoms, bisphenol-A-epichlorohydrin epoxy resin, or a compound having formula (I):

$$(OC_2H_3)—CH_2—O—R^1—O—CH_2—(C_2H_3O) \quad (I)$$

where $R^1$ is a linear or branched hydrocarbyl having from 4 to 24 carbon atoms, such as from 4 to 20, from 4 to 16, from 4 to 12, from 4 to 8, from 6 to 24, from 6 to 20, from 6 to 16, or from 6 to 12 carbon atoms. The epoxy resin can include bisphenol-A-based epoxy resins, bisphenol-F-based epoxy resins, aliphatic epoxy resins, Novalac resins, or combinations of these epoxy resins. Aliphatic epoxy resins may, for example, have the chemical formula (I). In some implementations, $R^1$ is an alkyl group. For example, the epoxy resin can include 1,6-hexanediol diglycidyl ether, which has formula (II):

$$(OC_2H_3)—CH_2—O—C_6H_{12}-O—CH_2—(C_2H_3O) \quad \text{(II)}$$

In some implementations, the epoxy resin includes at least one of 1,6-hexanediol diclycidyl ether, alkyl glycidyl ethers having from 12 to 14 carbon atoms, 2,3-epoxypropyl o-tolyl ether, or bisphenol-A-epichlorohydrin epoxy resin. In some implementations, the epoxy resin includes at least one of 1,6-hexanediol diclycidyl ether, alkyl glycidyl ethers having from 12 to 14 carbon atoms, or 2,3-epoxypropyl o-tolyl ether.

In some implementations, the epoxy resin has an epoxy value of from about 4.5 epoxy equivalents per kilogram of the epoxy resin to about 5.5 epoxy equivalents per kilogram of the epoxy resin. The epoxy equivalent weight of an epoxy resin is the weight of the epoxy resin in grams that contains one equivalent weight of epoxy. The epoxy equivalent weight of the epoxy resin is equal to the molecular weight of the epoxy resin divided by the average number of epoxy groups in the epoxy resin. In some implementations, the epoxy resin has an epoxy equivalent weight of from about 170 to about 350 grams of resin per epoxy equivalent (g/eq). The epoxy value and epoxy equivalent weight of an epoxy resin can, for example, be determined according to standard testing methods, such as ASTM-D1652.

In some implementations, the epoxy resin of the composition 150 is modified with a reactive diluent. The type and amount of reactive diluent may influence the viscosity, flexibility, hardness, chemical resistance, mechanical properties, plasticizing effect, reactivity, crosslinking density, or other properties of the epoxy resin. In some implementations, the reactive diluent is added to the epoxy resin to change the viscosity of the epoxy resin, such as to reduce the viscosity of the epoxy resin. In some implementations, the reactive diluent is added to improve at least one of the adhesion, the flexibility, or the solvent resistance of the epoxy resin. The reactive diluent can include a non-functional, mono-functional, di-functional, or multi-functional reactive diluent. For example, a non-functional reactive diluent does not have an epoxide functional group. As used in relation to reactive diluents, the term "functional" refers to the reactive diluent having at least one epoxide functional group. Therefore, a functional reactive diluent may have one, two, three, or more than three epoxide functional groups. The term "non-functional", as used in relation to reactive diluents, refers to a reactive diluent that does not have at least one epoxide functional group. Thus, a non-functional reactive diluent does not have at least one epoxide functional group, but still participates in at least one chemical reaction during reaction of the epoxide resin. The term "non-reactive diluent" refers to a diluent that does not participate in a chemical reaction during reaction of the epoxy resin. Examples of reactive and non-reactive diluents include, but are not limited to, propylene glycol diglycidyl ether, butanediol diglycidyl ether, cardanol glycidyl ether derivatives, propanetriol triglycidyl ether, aliphatic monoglycidyl ethers of C13-C15 alcohols, or combinations of functional or non-functional reactive diluents and non-reactive diluents. In some implementations, the epoxy resin includes a reactive diluent having the formula (III):

$$R_2—O—CH_2—(C_2H_3O) \quad \text{(III)}$$

where $R^2$ is a hydrocarbyl having from 12 to 14 carbon atoms. $R^2$ can be linear, branched, or cyclic. In some implementations, $R^2$ can be an alkyl group.

In some implementations, the epoxy resin includes an amount of reactive diluent that reduces the viscosity of the epoxy resin. In some implementations, the epoxy resin includes an amount of reactive diluent that modifies one or more of the adhesion, the flexibility, or the solvent resistance of the epoxy resin. In some implementations, the epoxy resin includes from 1 wt. % to 30 wt. % of the reactive diluent based on the total weight of the epoxy resin portion of the composition 150. As used in this disclosure, the term "epoxy resin portion" refers to the constituents of the epoxy resin system that do not include the curing agent, weighting agents (such as barite or volcanic ash), or other additives, such as accelerators or retarders. The epoxy resin portion includes the epoxy resins and any added reactive or non-reactive diluent. In some implementations, the epoxy resin includes from about 1 wt. % to about 20 wt. %, from about 1 wt. % to about 16 wt. %, from about 1 wt. % to about 14 wt. %, from about 1 wt. % to about 12 wt. %, from about 5 wt. % to about 30 wt. %, from about 5 wt. % to about 20 wt. %, from about 5 wt. % to about 16 wt. %, from about 5 wt. % to about 14 wt. %, from about 5 wt. % to about 12 wt. %, from about 10 wt. % to about 30 wt. %, from about 10 wt. % to about 20 wt. %, from about 10 wt. % to about 16 wt. %, from about 10 wt. % to about 14 wt. %, from about 12 wt. % to about 30 wt. %, from about 12 wt. % to about 20 wt. %, from about 12 wt. % to about 16 wt. %, from about 14 wt. % to about 30 wt. %, from about 14 wt. % to about 20 wt. %, or from about 14 wt. % to about 16 wt. % of the reactive diluent based on the total weight of the epoxy resin portion of the composition 150.

In some implementations, the epoxy resin includes bisphenol-A-(epichlorohydrin) epoxy resin with oxirane mono [(C12-C14)-alkyloxy)methyl]derivatives. Bisphenol-A-epichlorohydrin epoxy resin is an epoxy resin made by reaction of bisphenol-A and epichlorohydrin. The bisphenol-A-(epichlorohydrin) epoxy resin may then be modified with the reactive diluent oxirane mono [(C12-C14)-alkyloxy) methyl] derivatives to reduce the viscosity of the resin and improve the adhesion, flexibility, and solvent resistance of the final epoxy resin.

The bisphenol-A-(epichlorohydrin) epoxy resin with the reactive diluent oxirane mono [(C12-C14)-alkyloxy) methyl] derivatives may modify the viscosity of the composition 150, or may provide the composition 150 with a non-crystallizing resin and improved mechanical and chemical resistance compared to compositions without the bisphenol-A-(epichlorohydrin) epoxy resin with the reactive diluent oxirane mono [(C12-C14)-alkyloxy) methyl] derivatives. In some implementations, the epoxy resin includes from about 80 wt. % to about 90 wt. %, from about 80 wt. % to about 88 wt. %, from about 80 wt. % to about 86 wt. %, from about 80 wt. % to about 84 wt. %, from about 82 wt. % to about 90 wt. %, from about 82 wt. % to about 88 wt. %, from about 82 wt. % to about 86 wt. %, from v82 wt. % to about 84 wt. %, from about 84 wt. % to about 90 wt.

%, from about 84 wt. % to about 88 wt. %, or from about 84 wt. % to about 86 wt. % of the bisphenyl-A-epichlorohydrin epoxy resin based on the total weight of the epoxy resin portion of the composition 150. In some implementations, the epoxy resin includes from about 10 wt. % to about 20 wt. %, from about 10 wt. % to about 18 wt. %, from about 10 wt. % to about 16 wt. %, from about 10 wt. % to about 14 wt. %, from about 12 wt. % to about 20 wt. %, from about 12 wt. % to about 18 wt. %, from about 12 wt. % to about 16 wt. %, from about 12 wt. % to about 14 wt. %, from about 14 wt. % to about 20 wt. %, from about 14 wt. % to about 18 wt. %, or from about 14 wt. % to about 16 wt. % oxirane mono [(C12-C14)-alkyloxy)methyl]derivatives based on the total weight of the epoxy resin portion of the composition 150.

In some implementations, the epoxy resin including the bisphenol-A-(epichlorohydrin) epoxy resin with the reactive diluent oxirane mono [(C12-C14)-alkyloxy) methyl] derivatives can have an epoxy value of from about 4.76 epoxy equivalents per kilogram of epoxy resin to about 5.26 epoxy equivalents per kilogram of epoxy resin. The epoxy resin including the bisphenol-A-(epichlorohydrin) epoxy resin with the reactive diluent oxirane mono [(C12-C14)-alkyloxy) methyl] derivatives can have an epoxy equivalent weight of from about 190 g/eq to about 210 g/eq and a dynamic viscosity of from about 600 μmillipascal seconds (mPa·s) to about 1,200 μmPa·s, or from about 600 μmPa·s to about 900 μmPa·s. In some implementations, the epoxy resin includes 2,3-epoxypropyl-o-tolyl ether, which can have an epoxy equivalent weight of from about 170 g/eq to 190 g/eq and exhibit a dynamic viscosity of from 7 μmPa·s to 10 μmPa·s. In other implementations, the epoxy resin may include alkyl glycidyl ethers having from 12 to 14 carbon atoms, which may have an epoxy equivalent weight of from about 270 g/eq to about 305 g/eq and can exhibit a dynamic viscosity of from about 5 μmPa-s to about 12 μmPa-s. In some implementations, the epoxy resin includes 1,6-hexanediol diclycidyl ether, which can have an epoxy equivalent weight of from about 150 g/eq to about 170 g/eq and can exhibit a dynamic viscosity of from about 20 μmPa·s to about 30 μmPa-s.

In some implementations, the composition 150 includes a plurality of epoxy resins. For example, in some implementations, the composition 150 includes a combination of two or more of bisphenol-A-epichlorohydrin epoxy resin, 2,3-epoxypropyl-o-tolyl ether, C12-C14 alkyl glycidyl ether, or 1,6-hexanediol diglycidyl ether epoxy resin. In some implementations, the epoxy resin includes a mixture of 1,6-hexanediol diglycidyl ether epoxy resin and bisphenol-A-epichlorohydrin epoxy resin with the reactive diluent oxirane mono [(C12-C14)-alkyloxy)methyl]derivatives.

The composition 150 includes an amount of the epoxy resin necessary to form a cured epoxy composition downhole. For example, the composition 150 can include from about 20 wt. % to about 99 wt. % of the epoxy resin based on the total weight of the composition 150 prior to curing and forming the plug 150'. In some implementations, the composition 150 includes from about 20 wt. % to about 97 wt. %, from about 20 wt. % to about 95 wt. %, from about 20 wt. % to about 90 wt. %, from about 20 wt. % to about 80 wt. %, from about 20 wt. % to about 60 wt. %, from about 40 wt. % to about 99 wt. %, from about 40 wt. % to about 97 wt. %, from about 40 wt. % to about 95 wt. %, from about 40 wt. % to about 90 wt. %, from about 40 wt. % to about 80 wt. %, from about 40 wt. % to about 60 wt. %, from about 60 wt. % to about 99 wt. %, from about 60 wt. % to about 97 wt. %, from about 60 wt. % to about 95 wt. %, from about 60 wt. % to about 90 wt. %, from about 60 wt. % to about 80 wt. %, from about 80 wt. % to about 99 wt. %, from about 80 wt. % to about 97 wt. %, from about 80 wt. % to about 95 wt. %, from about 80 wt. % to about 90 wt. %, from about 90 wt. % to about 99 wt. %, from about 90 wt. % to about 97 wt. %, or from about 90 wt. % to about 95 wt. % of the epoxy resin based on the total weight of the composition 150 prior to curing and forming the plug 150'.

As previously discussed, the composition 150 includes a curing agent to cure the epoxy resin. The curing agent can include at least one of an amine, polyamine, amine adduct, polyamine adduct, alkanolamine, amide, polyamide, polyamide adduct, polyamide imidazoline, polyaminoamides, phenalkamine, or any combinations of these. Examples of amines and polyamine curing agents include, but are not limited to, aliphatic amines, cycloaliphatic amines, modified cycloaliphatic amines such as cycloaliphatic amines modified by polyacrylic acid, aliphatic polyamines, cycloaliphatic polyamines, modified polyamines such as polyamines modified by polyacrylic acid, and amine adducts such as cycloaliphatic amine adducts or polyamine adducts. In some implementations, the curing agent includes trimethyl hexamethylene diamine (TMD), diethylenetriamine (DETA), triethylenetetramine (TETA), meta-xylenediamine (MXDA), aminoethylpiperazine (AEP), tetraethylenepentamine (TEPA), polyetheramine, isophoronediamine (IPDA), beta-hydroxyalkyl amide (HAA), or any combinations of these. In some implementations, the curing agent includes DETA, TETA, TEPA, IPDA, or any combinations of these. In some implementations, the composition 150 includes a plurality of curing agents.

The composition 150 can include from about 1 wt. % to about 20 wt. % or from about 2 wt. % to about 30 wt. % of the curing agent(s). In some implementations, the composition 150 includes about 0.1 wt. % to about 50 wt. % curing agent(s). In some implementations, the composition 150 includes about 1.0 wt. % to about 40 wt. % curing agent(s). In some implementations, the composition 150 includes about 5.0 wt. % to about 30 wt. % curing agent(s). In some implementations, the composition 150 includes about 10 wt. % to about 25 wt. % curing agent(s). In some implementations, the composition 150 includes about 12 wt. % to about 20 wt. % curing agent(s).

In some implementations, the composition 150 includes about 1.0 wt. % to about 10 wt. % curing agent(s). In some implementations, the composition 150 includes about 1.5 wt. % to about 8.0 wt. % curing agent(s). In some implementations, the composition 150 includes about 2.0 wt. % to about 6.0 wt. % curing agent(s). In some implementations, the composition 150 includes about 2.0 wt. % to about 4.0 wt. % curing agent(s).

In some implementations, the composition 150 includes about 1.0 wt. % curing agent(s). In some implementations, the composition 150 includes about 1.5 wt. % curing agent(s). In some implementations, the composition 150 includes about 2.0 wt. % curing agent(s). In some implementations, the composition 150 includes about 2.1 wt. % curing agent(s). In some implementations, the composition 150 includes about 3.0 wt. % curing agent(s). In some implementations, the composition 150 includes about 4.0 wt. % curing agent(s). In some implementations, the composition 150 includes about 5.0 wt. % curing agent(s). In some implementations, the composition 150 includes about 6.0 wt. % curing agent(s). In some implementations, the composition 150 includes about 7.0 wt. % curing agent(s). In some implementations, the composition 150 includes about 8.0 wt. % curing agent(s). In some implementations, the composition 150 includes about 9.0 wt. % curing agent(s). In some implementations, the composition 150 includes about 10 wt. % curing agent(s).

In some implementations, the composition 150 includes about 11.0 wt. % curing agent(s). In some implementations, the composition 150 includes about 12.0 wt. % curing agent(s). In some implementations, the composition 150 includes about 13.0 wt. % curing agent(s). In some implementations, the composition 150 includes about 14.0 wt. % curing agent(s). In some implementations, the composition 150 includes about 15.0 wt. % curing agent(s). In some implementations, the composition 150 includes about 16.0 wt. % curing agent(s). In some implementations, the composition 150 includes about 17.0 wt. % curing agent(s). In some implementations, the composition 150 includes about 18.0 wt. % curing agent(s). In some implementations, the composition 150 includes about 19.0 wt. % curing agent(s). In some implementations, the composition 150 includes about 20 wt. % curing agent(s).

In some implementations, the composition 150 includes about 21.0 wt. % curing agent(s). In some implementations, the composition 150 includes about 22.0 wt. % curing agent(s). In some implementations, the composition 150 includes about 23.0 wt. % curing agent(s). In some implementations, the composition 150 includes about 24.0 wt. % curing agent(s). In some implementations, the composition 150 includes about 25.0 wt. % curing agent(s). In some implementations, the composition 150 includes about 26.0 wt. % curing agent(s). In some implementations, the composition 150 includes about 27.0 wt. % curing agent(s). In some implementations, the composition 150 includes about 28.0 wt. % curing agent(s). In some implementations, the composition 150 includes about 29.0 wt. % curing agent(s). In some implementations, the composition 150 includes about 30 wt. % curing agent(s).

The curing agent can include an amine curing agent having an amine value that enables the amine curing agent to fully cure the composition 150 to form the plug 150' downhole. The amine value of a curing agent provides the active hydrogen (NH) content of an amine curing agent. The amine value can be expressed as the weight in milligrams of potassium hydroxide (KOH) needed to neutralize the NH in 1 gram of the amine curing agent. In some implementations, the curing agent has an amine value of from about 250 μmilligrams of KOH per gram (mg KOH/g) to about 1,700 μmg KOH/g, from about 250 μmg KOH/g to about 1,650 μmg KOH/g, from about 250 mg KOH/g to about 1,600 μmg KOH/g, from about 450 μmg KOH/g to about 1,700 μmg KOH/g, from about 450 μmg KOH/g to about 1,650 μmg KOH/g, from about 450 μmg KOH/g to about 1,600 μmg KOH/g, from about 650 μmg KOH/g to about 1,700 μmg KOH/g, from about 650 μmg KOH/g to about 1,650 μmg KOH/g, or from about 650 μmg KOH/g to about 1,600 μmg KOH/g. The amine value ($V_A$) may be determined by titrating a solution of the curing agent with a dilute acid, such as a 1 μmolar (M) solution of hydrogen chloride (HCl). The amine value may then be calculated from the amount of HCl needed to neutralize the amine in the solution according to Equation 1 (EQU. 1):

$$V_A = \frac{V_{HCl} \times N_{HCl} \times MW_{KOH}}{W} \quad \text{(EQU. 1)}$$

where $V_{HCl}$ is the volume in milliliters of HCl needed to neutralize the amine, $N_{HCl}$ is the normality of HCl used to titrate the amine, $MW_{KOH}$ is the molecular weight of KOH in grams per mole, and W is the weight in grams of the curing agent sample titrated. The amine number ($N_A$) of the known pure amine curing agent may be calculated from Equation 2 (EQU. 2):

$$N_A = \frac{1,000 \times MW_{KOH}}{MW_{CA}} \quad \text{(EQU. 2)}$$

where $MW_{KOH}$ is the molecular weight of KOH in grams per mole and $MW_{CA}$ is the molecular weight of the curing agent in grams per mole.

In some implementations, the amine curing agent can have an amine hydrogen equivalent weight (AHEW) that enables the amine curing agent to fully cure the composition 150 to form the plug 150' downhole. The AHEW of an amine curing agent refers to the grams of the amine curing agent containing 1 equivalent of amine. The AHEW of an amine curing agent may be calculated by dividing the molecular weight of the amine curing agent in grams per mole by the number of active hydrogens per molecule. In some implementations, the curing agent can be an amine curing agent having an AHEW of from about 20 grams (g) to about 120 g, from about 20 g to about 115 g, from about 20 g to about 110 g, from about 20 g to about 100 g, from about 40 g to about 120 g, from about 40 g to about 115 g, from about 40 g to about 110 g, from about 40 g to about 110 g, from about 60 g to about 120 g, from about 60 g to about 115 g, or from about 60 g to about 110 g.

The curing time of the composition 150 may be inversely proportional to the amount of curing agent in the composition 150. For example, increasing the amount of the curing agent in the composition 150 may result in a decrease in the curing time of the composition 150 to form the plug 150'. In some implementations, the composition 150 includes an amount of curing agent capable of curing the epoxy resin in the composition 150 to a semi-solid state (to form the plug 150') in a cure time of from about 4 hours to about 12 hours. As used in this disclosure, the term "semi-solid" refers to a state of the compositions that is between a liquid and a solid in which the composition exhibits high elasticity and flexibility. In the semi-solid state, the sealing composition may be easily deformed but may return to shape upon releasing the deforming force. The composition 150 cured to a semi-solid or solid state is capable of sealing an annulus or wall of the wellbore. In some implementations, the composition 150 includes an amount of the curing agent capable of curing the composition 150 to a semi-solid state (to form the plug 150') within a cure time of from about 4 hours to about 9 hours. In some implementations, the composition 150 includes from about 0.1 wt. % to about 20 wt. % of the curing agent based on the total weight of the composition 150 prior to curing and forming the plug 150'. In some implementations, the composition 150 includes from about 0.1 wt. % to about 15 wt. %, from about 0.1 wt. % to about 10 wt. %, from about 0.1 wt. % to about 5 wt. %, from about 0.5 wt. % to about 20 wt. %, from about 0.5 wt. % to about 15 wt. %, from about 0.5 wt. % to about 10 wt. %, from about 0.5 wt. % to about 5 wt. %, from about 1 wt. % to about 20 wt. %, from about 1 wt. % to about 15 wt. %, from about 1 wt. % to about 10 wt. %, from about 1 wt. % to about 5 wt. %, from about 5 wt. % to about 20 wt. %, from about 5 wt. % to about 15 wt. %, from about 5 wt. % to about 10 wt. %, or from about 10 wt. % to about 20 wt. % of the curing agent based on the total weight of the composition 150 prior to curing and forming the plug 150'.

In some implementations, the composition 150 includes an additive to modify the speed of the reaction between the epoxy resin and the curing agent or to modify other properties of the composition 150, such as viscosity, yield point (YP), or other rheological properties. For example, the composition 150 can include an accelerator or a retarder to speed up or slow down, respectively, the reaction between the epoxy resin and the curing agent. Accelerators can include alcohols, phenols, aminoalcohols, or amines. Examples of accelerators include, but are not limited to benzyl alcohol, mono-nonylphenol, triethanolamine (TEA), amino-n-propyl diethanolamine, n,n-dimethyldipropylenetramine, or any combinations of these. Examples of retarders include, but are not limited to, lignin, gums, starches, lignosulphonate derivatives, or any combinations of these. In some implementations, the composition 150 includes an amount of the accelerator capable of decreasing the cure time of the composition 150 from greater than 12 hours to a cure time in a range of from about 1 hour to about 12 hours. In some implementations, the composition 150 includes from about 0.01 wt. % to about 10 wt. % of the accelerator based on the total weight of the composition 150 prior to curing and forming the plug 150'. In some implementations, the composition 150 includes from about 0.01 wt. % to about 5 wt. %, from about 0.01 wt. % to about 3 wt. %, from about 0.01 wt. % to about 1 wt. %, from about 0.1 wt. % to about 10 wt. %, from about 0.1 wt. % to about 5 wt. %, from about 0.1 wt. % to about 3 wt. %, from about 0.1 wt. % to about 1 wt. %, from about 1 wt. % to about 10 wt. %, from about 1 wt. % to about 5 wt. %, or from about 1 wt. % to about 3 wt. % of the accelerator based on the total weight of the composition 150 prior to curing and forming the plug 150'.

In some implementations, the composition 150 includes a weighting material. The weighting material can include particulate solids having a specific gravity (SG) that increases the density of the composition 150. The weighting material can be added to the composition 150 to increase the density of the final cured resin (plug 150') to increase the hydrostatic pressure exerted by the plug 150' on the wellbore wall or interior surface of an outer tubular string. The final density of the cured resin (plug 150') may depend on the geology of the subterranean formation in the loss zone being sealed. For example, the subterranean formation may require that the composition 150 have a greater density to support the wellbore and prevent flow of fluids from the subterranean formation into the wellbore during curing of the composition 150 to form the plug 150'. The weighting material can have a specific gravity (SG) of from about 2 to about 6. Examples of weighting materials include, but are not limited to, sand, barite (barium sulfate), hematite, calcium carbonate, siderite, ilmenite, silica sand, manganese oxide (MnO), hausmanite (manganese tetraoxide ($Mn_3O_4$), zinc oxide, zirconium oxide, iron oxide, fly ash, or any combinations of these. In some implementations, the composition 150 includes from about 0.1 wt. % to about 40 wt. % of the weighting material based on the total weight of the composition 150 prior to curing and forming the plug 150'. In some implementations, the composition 150 includes from about 0.1 wt. % to about 30 wt. %, from about 0.1 wt. % to about 20 wt. %, from about 0.1 wt. % to about 10 wt. %, from about 1 wt. % to about 40 wt. %, from about 1 wt. % to about 30 wt. %, from about 1 wt. % to about 20 wt. %, from about 1 wt. % to about 10 wt. %, from about 5 wt. % to about 40 wt. %, from about 5 wt. % to about 30 wt. %, from about 5 wt. % to about 20 wt. %, from about 5 wt. % to about 10 wt. %, from about 10 wt. % to about 40 wt. %, from about 10 wt. % to about 30 wt. %, from about 10 wt. % to about 20 wt. %, or from about 20 wt. % to about 40 wt. % of the weighting material based on the total weight of the composition 150 prior to curing and forming the plug 150'.

In some implementations, the composition 150 can include a modifier, such as cardanol liquid, polyacrylate flow agents, or any combinations of these. A modifier can be added to the composition 150 to adjust the viscosity of the composition 150.

In some implementations, the composition 150 includes from about 20 wt. % to about 97 wt. % of the epoxy resin and from about 1 wt. % to about 20 wt. % of the curing agent based on the total weight of the composition, where the epoxy resin includes at least one of 2,3-epoxypropyl o-tolyl ether, alkyl glycidyl ethers having from 12 to 14 carbon atoms, or the compound having formula (I). In some implementations, the composition 150 includes from about 20 wt. % to about 97 wt. % of bisphenol-A-epichlorohydrin epoxy resin with the reactive diluent oxirane mono [(C12-C14)-alkyloxy)methyl]derivatives and from about 1 wt. % to about 20 wt. % of TEPA (curing agent). In some implementations, the composition 150 includes from about 10 wt. % to about 80 wt. % of bisphenol-A-epichlorohydrin epoxy resin with the reactive diluent oxirane mono [(C12-C14)-alkyloxy)methyl]derivatives, from about 10 wt. % to about 80 wt. % of 1,6-hexanediol diglycidyl ether, and from about 1 wt. % to about 20 wt. % of TEPA (curing agent). In some implementations, the composition 150 includes from about 1 wt. % to about 40 wt. % of $Mn_3O_4$ weighting material.

In some implementations, the composition 150 exhibits a cure time of greater than or equal to about 4 hours, greater than or equal to about 5 hours, or greater than or equal to about 6 hours. In some implementations, the composition 150 exhibits a cure time of less than or equal to about 12 hours, less than or equal to about 10 hours, or less than or equal to about 9 hours. In some implementations, the composition 150 exhibits a cure time of from about 4 hours to about 12 hours, from about 4 hours to about 10 hours, from about 4 hours to about 9 hours, from about 4 hours to about 6 hours, from about 5 hours to about 12 hours, from about 5 hours to about 10 hours, from about 5 hours to about 9 hours, from about 6 hours to about 12 hours, from about 6 hours to about 10 hours, from about 6 hours to about 9 hours, from about 9 hours to about 12 hours, or from about 10 hours to about 12 hours.

In some implementations, a method of isolating a lost circulation zone of a wellbore includes introducing a spacer fluid into the lost circulation zone and introducing an LCM composition 150 into the lost circulation zone. The method can include curing the LCM composition 150 to form a cured LCM composition (e.g., plug 150') sealing the lost circulation zone. The composition 150 can be used for sealing the annulus or remediating a wellbore under a range of different downhole conditions in the wellbore. For example, the composition 150 can be adapted to different downhole conditions by changing the concentrations of the epoxy resin, curing agent, accelerator, emulsifier, weighting material, or any combinations of these in the composition 150 to modify the specific gravity, viscosity, mechanical properties, curing time, or other properties of the composition 150. The plug 150' formed by curing the composition 150 downhole can be capable of withstanding a wide range of temperatures and pressures without failing or deteriorating. Failure or deterioration of the plug 150' would allow fluids to penetrate into or through the plug 150', which is undesirable. For example, once the composition 150 has cured and formed the plug 150', the plug 150' can be capable of withstanding temperatures of from about 20 degrees Celsius (° C.) to about 205° C. The plug 150' can be able to withstand temperature cycling within a temperature range of from about 20° C. to about 205° C. The plug 150' can be capable of withstanding pressures of up to about 4,000,000 pounds of force per square inch (psi) (about 27,579,029 kilopascals (kPa)). For example, the plug 150' can be capable of withstanding pressures of from about 14 psi (about 97 kPa) to about 4,000,000 psi (about 27,579,029 kPa) without failing or deteriorating.

When used as a sealing composition, the composition 150 can have a viscosity that enables the composition 150 to be transferred into an annulus between an exterior surface of a tubular disposed within the well and a wellbore wall or interior surface of a second tubular surrounding the first tubular. In some implementations, the composition 150 has a viscosity that enables introduction of the composition 150 into a remediation area (such as a loss zone) of the well. In some implementations, the composition 150 has a high viscosity that enables injection of the composition 150 into the subterranean formation, such as a high-injectivity zone of the well. The rheology and density of the composition 150 can be adjusted over a wide range of values depending on the requirement for the well and the downhole conditions of the well. The composition 150 can have a density that enables the composition 150 to exert hydrostatic pressure on the wellbore wall or interior surface of an outer casing to support the wellbore, prevent fluids from flowing from the subterranean formation into the wellbore, or both. In some implementations, the composition 150 can have a density of from about 55 pounds per cubic foot (lbm/ft$^3$) to about 170 lbm/ft$^3$ μmeasured immediately after addition of the curing agent and before substantial curing has occurred. As used in this disclosure, the term "substantial curing" refers to an amount of curing that produces a change of greater than 5 percent (%) in any rheological property of the composition 150. In some implementations, the composition 150 can have a density of from about 55 lbm/ft$^3$ to about 150 lbm/ft$^3$, from about 55 lbm/ft$^3$ to about 130 lbm/ft$^3$, from about 55 lbm/ft$^3$ to about 110 lbm/ft$^3$, from about 55 lbm/ft$^3$ to 90 about lbm/ft$^3$, from about 60 lbm/ft$^3$ to about 170 lbm/ft$^3$, from about 60 lbm/ft$^3$ to about 150 lbm/ft$^3$, from about 60 lbm/ft$^3$ to about 130 lbm/ft$^3$, from about 60 lbm/ft$^3$ to about 110 lbm/ft$^3$, from about 60 lbm/ft$^3$ to about 90 lbm/ft$^3$, from about 80 lbm/ft$^3$ to about 170 lbm/ft$^3$, from about 80 lbm/ft$^3$ to about 130 lbm/ft$^3$, from about 80 lbm/ft$^3$ to about 110 lbm/ft$^3$, from 90 about lbm/ft$^3$ to 150 about lbm/ft$^3$, or from about 90 lbm/ft$^3$ to about 130 lbm/ft$^3$.

The viscosity of the composition 150 may be increased sufficiently to enable the plug 150' formed by curing the composition 150 to seal a large loss circulation zone utilizing emulsifiers. In some implementations, the composition 150 includes about 0.01 wt. % to about 50 wt. % emulsifier(s). In some implementations, the composition 150 includes about 0.1 wt. % to about 40 wt. % emulsifier(s). In some implementations, the composition 150 includes about 1.0 wt. % to about 30 wt. % emulsifier(s). In some implementations, the composition 150 includes about 5.0 wt. % to about 25 wt. % emulsifier(s). In some implementations, the composition 150 includes about 10 wt. % to about 20 wt. % emulsifier(s). Some non-limiting examples of emulsifiers that can be included in the composition 150 include oxyethylated alkyl phenol (e.g., AKTAFLO®-E), ethoxylated phenol in water (e.g., AKTAFLO®-S with 40 wt. % water, 57 wt. % 30-mole ethoxylate of p-nonylphenol, and 3 wt. % 2-mole ethoxylate of p-nonylphenol), carboxylic acid terminated fatty polyamide in biodiesel base (e.g., BDF 535 with 46.49 wt. % tall oil fatty acid, 8.23 wt. % diethylenetriamine, 0.1 wt. % triethylenetetramine, 0.1 wt. % tetraethylenepentamine, 40 wt. % biodiesel, and 8.02 wt. % maleic anhydride), carboxylic acid terminated fatty polyamide (e.g., BDF 536 with 26.26 wt. % tall oil fatty acid, 6.35 wt. % diethylenetriamine, 60 wt. % biodiesel, and 9.06 wt. % maleic anhydride or BDF 537 with 37.84 wt. % tall oil fatty acid, 6.32 wt. % diethylenetriamine, 0.1 wt. % triethylenetetramine, 0.1 wt. % tetraethylenepentamine, 55 wt. % biodiesel, and 6.02 wt. % maleic anhydride or LE SUPERMUL with 47.72 wt. % distilled tall oil fatty acid, 8.19 wt. % diethylenetriamine, 0.1 wt. % triethylenetetramine, 0.1 wt. % tetraethylenepentamine, 27.43 wt. % olefin, 8.26 wt. % maleic anhydride, and 8.2 wt. % blend of ethylene glycol monobutyl ether (EGBE) and diethylene glycol butyl ether (DGBE)), modified amidoamine in low-toxicity mineral oil (e.g., BAROMUL 303, an oil-wetting agent and an invert emulsifier for mineral oil), polyolefin amide alkene amine (e.g., BROMI-MUL, a non-ionic surfactant), unbleached soya lecithin (e.g., DRILTREAT, a lecithin liquid dispersion that can quickly change natural water-wetting characteristics of drilled solids and weighting agents in oil muds), distilled tall oil fatty acid (e.g., EZ-CORE), carboxylic acid terminated fatty polyamide in diesel base (e.g., EZ MUL with 83.54 wt. % 2/3-amide of tall oil fatty acid and polyamines, 8.26 wt. % maleic anhydride, and 8.2 wt. % blend of EGBE and DGBE; EZ MUL 2F with 83.54 wt. % 2/3-amide of tall oil fatty acid and polyamines, 8.26 wt. % maleic anhydride, 8.2 wt. % blend of EGBE and DGBE; EZ MUL NS with 83.54 wt. % 2/3-amide of tall oil fatty acid and polyamines, 8.26 wt. %, maleic anhydride, and 8.2 wt. % blend of EGBE and DGBE; EZ MUL NT with 83.54 wt. % 2/3-amide of tall oil fatty acid and polyamines, 8.26 wt. % maleic anhydride, and 8.2 wt. % blend of EGBE and DGBE; or FORTI-MUL with 47.72 wt. % tall oil fatty acid, 8.19 wt. % diethylenetriamine, 0.1 wt. % triethylenetetramine, 0.1 wt. % tetraethylenepentamine, 27.43 wt. % diesel fuel #2 grade, 8.26 wt. % maleic anhydride, 8.2 wt. % blend of EGBE and DGBE), a mixture of modified tall oil and carboxylic acid terminated fatty polyamide (e.g., FACTANT with 70 wt. % XTOL MTO 692 and 30 wt. % EZ MUL NT concentrate), carboxylic acid terminated fatty polyamide (e.g., FORMULADE with 47.72 wt. % distilled tall oil fatty acid, 8.19 wt. % diethylenetriamine, 0.1 wt. % triethylenetetramine, 0.1 wt. % tetraethylenepentamine, 27.43 wt. % olefin, 8.26 wt. % maleic anhydride, and 8.2 wt. % blend of EGBE and DGBE), oxidized tall oil/fatty amidoamine blend in diesel base (e.g., INVERMUL with 28 wt. % carboxylic acid terminated fatty polyamide in diesel base, 18 wt. % diesel fuel #2 grade, and 54 wt. % oxidized tall oil or THERMO MUL with 28 wt. % carboxylic acid terminated fatty polyamide in diesel base, 18 wt. % diesel fuel #2 grade, and 54 wt. % oxidized tall oil), oxidized tall oil/fatty amidoamine blend (e.g., INVERMUL NT with 28 wt. % carboxylic acid terminated fatty polyamide, 18 wt. % isoparaffinic solvent, and 54 wt. % oxidized tall oil or LE MUL with 18 wt. % olefin, 54 wt. % oxidized tall oil, and 28 wt. % carboxylic acid terminated fatty polyamide), ether carboxylic acid (e.g., PERFOR MUL), aqueous mixtures of glycols, phosphate ester, and ethanolamine (e.g., TORQ-TRIM 22, a blend of emulsifiers and alkaline surfactants fully dispersible in water), and transesterified diethanolamine (e.g., TORQ-TRIM II with 7.17 wt. % diethanolamine, 62.08 wt. % soybean oil, 0.75 wt. % stearic acid, and 30 wt. % isopropanol).

In some implementations, the components of the composition 150 are mixed in a lab. For example, the volcanic ash, the epoxy resin, and the curing agent are maxed using a standard API blender for 15 seconds at 4,000 revolutions per minute (rpm) and 35 seconds at 12,000 rpm. The equation for calculating mixing energy is shown by Equation 3 (EQU. 3):

$$\frac{E}{M} = \frac{k\omega^2 t}{V} \quad \text{(EQU. 3)}$$

where E is mixing energy in kiloJoules (kJ), M is mass of slurry in kilograms (kg), k is an empirical constant equal to $6.1\times10^{-8}$ μms/s, ω is rotational speed in radians per second (rad/s), t is mixing time in seconds (s), and V is slurry volume in cubic meters ($m^3$).

In some implementations, the composition 150 exhibits a thickening time at 100 degrees Fahrenheit (° F.) (37.8° C.) of greater than about 1 hour, greater than about 1.5 hours, greater than about 1.75 hours, greater than about 2 hours, or greater than about 6 hours. A thickening time test can be performed to simulate pumping conditions in order to determine a duration of time before the composition 150 becomes too difficult or impossible to pump (flow).

The viscosity of the composition 150 can be measured using a standard oilfield viscometer, such as a FANN® Model 35 viscometer manufactured by Fann Instrument Company, for example, according to test methods provided in the API Recommended Practice For Field Testing Water-Based Cement slurries (RP 13B-1/ISO 10414-1:2002). The viscometer reports shear stress readings at various shear rates. The shear stress readings can be reported in units of pounds of force per 100 square feet (lbf/100 $ft^2$) (4.79 dyne/$cm^2$). The shear rate can be measured in rpm. The viscometer may report shear stress readings at shear rates of at least one of 600 rpm, 300 rpm, 200 rpm, 100 rpm, 6 rpm, or 3 rpm. These shear stress readings may be used to determine the viscosity of the composition 150 at any of the shear rates, using Equation 4 (EQU. 4), assuming a viscometer with an R1 rotor sleeve, B1 bob, and F1 torsion spring:

$$\mu = \frac{300\,\theta_N}{N} \quad \text{(EQU. 4)}$$

where μ is viscosity in centipoise (cP), N is viscometer speed/shear rate in rpm, and $\theta_N$ is shear stress in lbf/100 $ft^2$ (4.79 dyne/$cm^2$).

The rheology of composition 150 can be modeled based on Bingham plastic flow behavior. In particular, the composition 150 including red mud behaves as a rigid body at lesser shear stress but flows as a viscous fluid at greater shear stress. The rheological behavior of the composition 150 can be determined by measuring the shear stress on the composition 150 at different shear rates, which can be accomplished by measuring the shear stress and/or shear rate on the composition 150, for example, using a FANN® Model 35 viscometer operated at 3 rpm, 6 rpm, 100 rpm, 200 rpm, 300 rpm, or 600 rpm. A Bingham plastic fluid can be modeled by Equation 5 (EQU. 5):

$$\tau = (PV)\dot{\gamma} + 4.79\,YP \quad \text{(EQU. 5)}$$

where τ is shear stress in dynes per square centimeter (dyne/$cm^2$), PV is plastic viscosity in cP, $\dot{\gamma}$ is shear rate is per second ($s^{-1}$), and YP is yield point in lbf/100 $ft^2$ (4.79 dyne/$cm^2$).

The rheology of the composition 150 can be evaluated from the plastic viscosity (PV) and the yield point (YP), which are parameters from the Bingham plastic rheology model. The PV is related to the resistance of the composition 150 to flow due to mechanical interaction between the solids of the composition 150 and represents the viscosity of the composition 150 extrapolated to infinite shear rate. In other words, the PV is the slope of the shear stress versus shear rate curve of the Bingham plastic model. The PV reflects the type and concentration of the solids in the composition 150, and a lesser PV is preferred. The PV of the composition 150 can be estimated by measuring the shear stress of the composition 150, for example, using a FANN® Model 35 viscometer at shear rates of 300 rpm and 600 rpm and subtracting the 300 rpm shear stress measurement from the 600 rpm shear stress measurement according to Equation 6 (EQU. 6):

$$PV = \theta_{600} - \theta_{300} \quad \text{(EQU. 6)}$$

where PV is plastic viscosity in cP, $\theta_{600}$ is shear stress at 600 rpm in lbf/100 $ft^2$ (4.79 dyne/$cm^2$), and $\theta_{300}$ is shear stress at 300 rpm in lbf/100 $ft^2$ (4.79 dyne/$cm^2$).

The YP represents the shear stress less than which the composition 150 behaves as a rigid body and greater than which the composition 150 flows as a viscous fluid. In other words, the YP represents the amount of stress required to move the composition 150 from a static condition. The yield point is the resistance of initial flow of a fluid, or the stress required in order to move the fluid. It can be simply stated that the yield point is the attractive force among colloidal particles in the composition 150. The YP of the composition 150 is correlated with the capacity of the composition 150 to carry rock cuttings through the annulus, which in simplified terms indicates the hole-cleaning ability of the composition 150. The determination of yield points in the composition 150 is important in the overall description of slurry flow properties. Yield point affects both the start-up pressure after a temporary shut-down and the void filling properties of the composition 150 during sealing operations. The YP of the composition 150 can be estimated by Equation 7 (EQU. 7) by subtracting the PV from Equation 5 (EQU. 5) from the shear stress of the composition 150 measured at 300 rpm (EQU. 6):

$$YP = \theta_{300} - PV \quad \text{(EQU. 7)}$$

Figure 2:
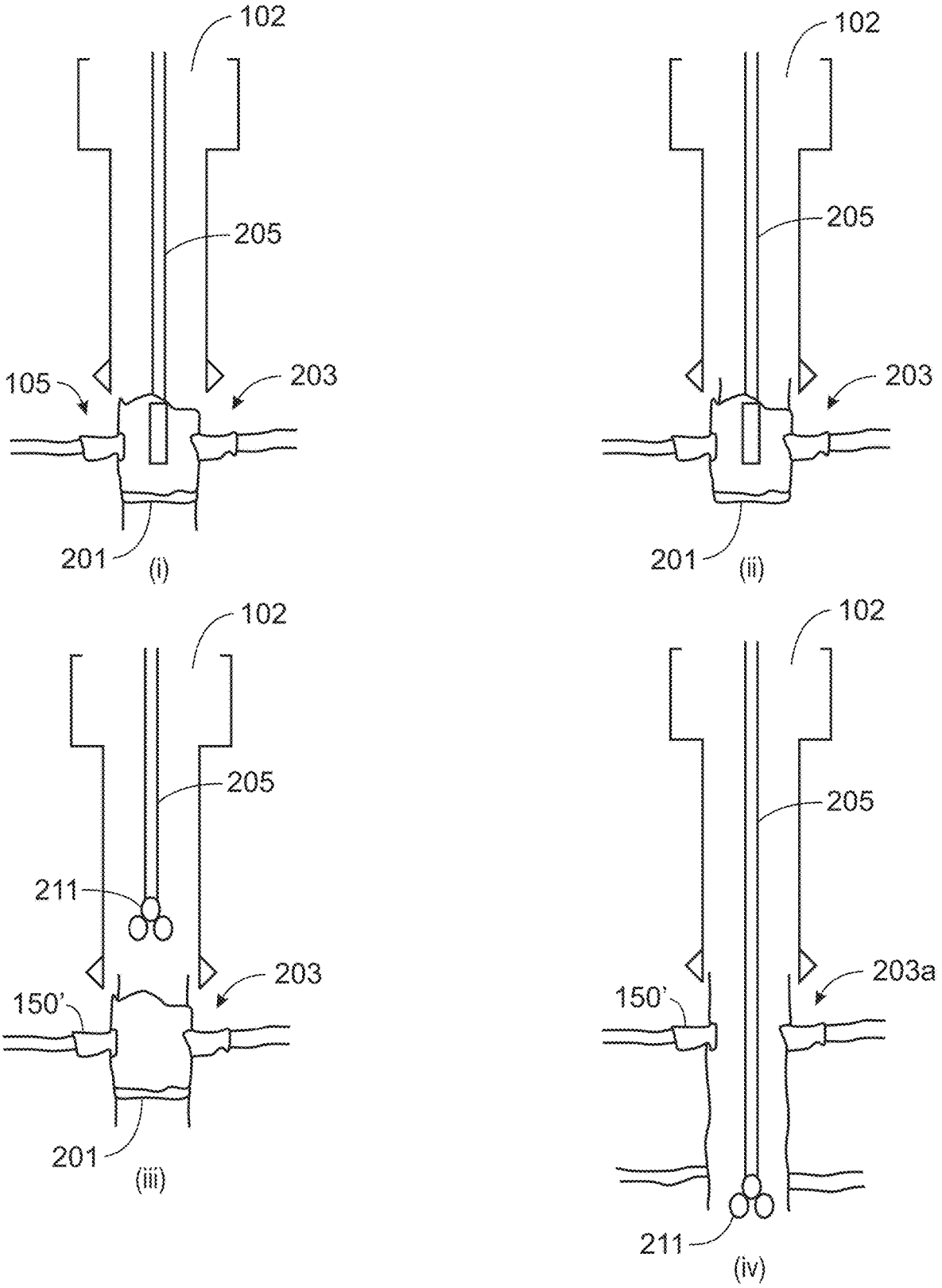
FIG. 2 is a progression of schematics depicting example stages of mitigating lost circulation in a well.

FIG. 2 is a progression 200 of schematics depicting example stages of mitigating/remedying lost circulation in a well, such as the well 100. At stage (i), drilling has been halted as a loss zone has been identified in the well 100. At stage (i), a bridge plug or packer 201 has been placed directly downhole of the desired location in the wellbore 102 that is in the vicinity of the loss zone 203 of the subterranean formation. An LCM composition (such as the composition 150) is flowed into the wellbore 102. For example, the composition 150 can be flowed into the wellbore 102 through a coiled tubing 205 extending from the surface (such as the surface 106). Exposure to the downhole temperature of the subterranean formation can, for example, facilitate gelation (curing) of the composition 150. At stage (ii), the composition 150 has cured to form a seal (such as the plug 150'). The plug 150' is configured to prevent fluid from flowing from the wellbore 102 and into the subterranean formation, thereby preventing loss of fluid into the subterranean formation. At stage (iii), drilling can be restarted. The drill bit 211 can be rotated to mill a portion of the plug 150' that is positioned within the wellbore 102. The drill bit 211 can be rotated to mill through the bridge plug/packer 201 that was placed at stage (i). Thus, the drill bit 211 can be rotated and mill through the plug 150' and bridge plug/packer 201 and drill further downhole to continue drilling the wellbore 102, for example, to increase the length of the wellbore 102 for penetrating deeper into the subterranean formation. At stage (iv), the drill bit 211 has drilled through the plug 150' and bridge plug/packer 201 and has drilled deeper into the subterranean formation. The loss zone 2203 has been mitigated and is no longer considered a loss zone. The zone is re-labeled as a remedied zone 203*a* in stage (iv) because fluids are no longer lost through the zone. In another lost circulation situation arises, the process can be repeated for the newly identified loss zone.

Figure 3:
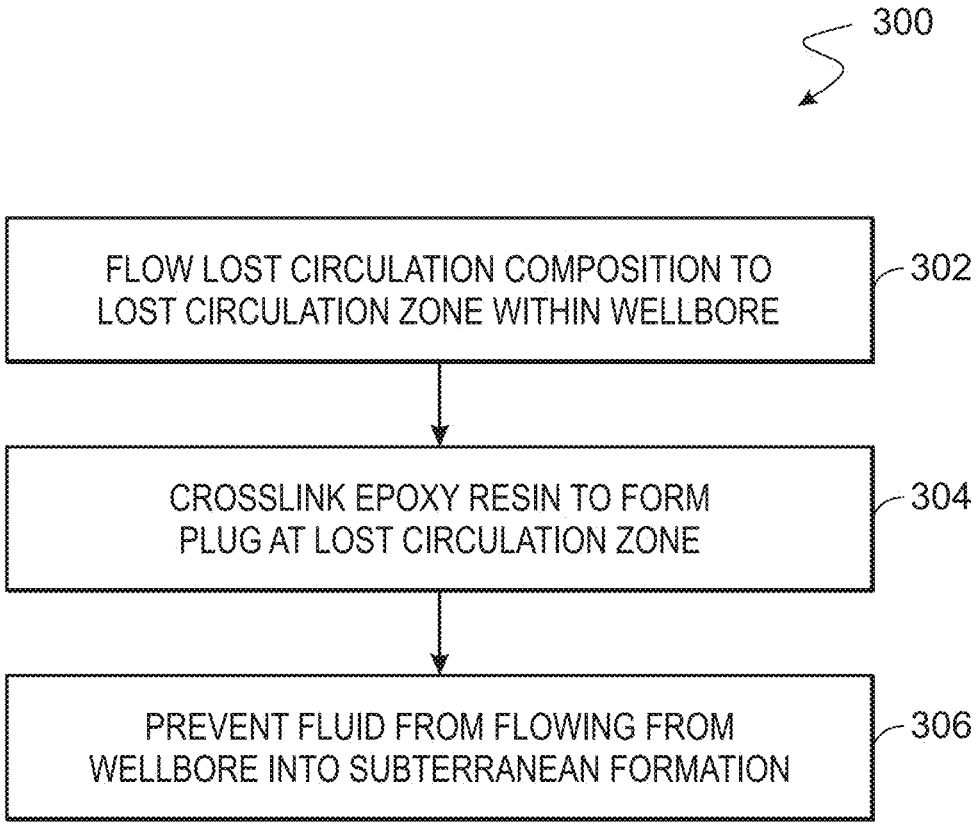
FIG. 3 is a flow chart of an example method for mitigating lost circulation in a well.

FIG. 3 is a flow chart of an example method 300 for mitigating/remedying lost circulation in a well, such as the well 100. At block 302, a lost circulation composition (such as the composition 150) is flowed to a lost circulation zone (such as loss zone 203) within a wellbore (such as the wellbore 102). As described previously, the lost circulation composition 150 includes volcanic ash, an epoxy resin, and a curing agent that includes nitrogen. The composition 150 can be flowed to the loss zone 203 at block 302, for example, through a coiled tubing (such as the coiled tubing 205) using a pump. At block 304, the curing agent of the composition 150 crosslinks the epoxy resin, thereby curing the composition 150 and forming a plug (such as the plug 150') at the loss zone 203 in response to exposure to a downhole condition (such as a downhole temperature) of the loss zone 203 of the wellbore 102. In some implementations, block 304 includes maintaining the lost circulation composition 150 within the lost circulation zone (loss zone 203) for a time duration sufficient for the curing agent to crosslink the epoxy resin and form the plug 150'. In some implementations, the lost circulation composition 150 is maintained within the loss zone 203 at block 304 for a time duration sufficient for the curing agent to crosslink the epoxy resin, such that the plug 150' becomes viscous and un-pumpable. In some implementations, the time duration for which the lost circulation composition 150 is maintained within the loss zone 203 at block 304 for the curing agent to crosslink the epoxy resin is in a range of from about 4 hours to about 12 hours. At block 306, the plug 150' prevents fluid from flowing from the wellbore 102 into the subterranean formation through the plug 150' at the loss zone 203. At block 306, the loss zone 203 is no longer considered a loss zone, but instead considered a remedied zone (such as the remedied zone 203*a*).

In some implementations, the plug 150' is capable of withstanding about 10 psi (about 69 kPa) to about 5,000,000 psi (about 34,473,786 kPa) without failing or deteriorating to allow liquids or gases to penetrate into or through the plug 150'. In some implementations, the plug 150' is capable of withstanding about 14 psi (about 97 kPa) to about 4,000,000 psi (about 27,579,029 kPa) without failing or deteriorating to allow liquids or gases to penetrate into or through the plug 150'. In some implementations, the plug 150' is capable of withstanding about 1,000 psi (about 6,895 kPa) to about 3,500,000 psi (about 24,131,651 kPa) without failing or deteriorating to allow liquids or gases to penetrate into or through the plug 150'. In some implementations, the plug 150' is capable of withstanding about 10,000 psi (about 68,948 kPa) to about 3,000,000 psi (about 20,684,272 kPa) without failing or deteriorating to allow liquids or gases to penetrate into or through the plug 150'. In some implementations, the plug 150' is capable of withstanding about 100,000 psi (about 689,476 kPa) to about 2,500,000 psi (about 17,236,893 kPa) without failing or deteriorating to allow liquids or gases to penetrate into or through the plug 150'. In some implementations, the plug 150' is capable of withstanding about 1,000,000 psi (about 6,894,757 kPa) to about 2,000,000 psi (about 13,789,515 kPa) without failing or deteriorating to allow liquids or gases to penetrate into or through the plug 150'.

In some implementations, the plug 150' is capable of withstanding about 10 psi (about 69 kPa) without failing or deteriorating to allow liquids or gases to penetrate into or through the plug 150'. In some implementations, the plug 150' is capable of withstanding about 14 psi (about 97 kPa) without failing or deteriorating to allow liquids or gases to penetrate into or through the plug 150'. In some implementations, the plug 150' is capable of withstanding about 1,000 psi (about 6,895 kPa) without failing or deteriorating to allow liquids or gases to penetrate into or through the plug 150'. In some implementations, the plug 150' is capable of withstanding about 10,000 psi (about 68,948 kPa) without failing or deteriorating to allow liquids or gases to penetrate into or through the plug 150'. In some implementations, the plug 150' is capable of withstanding about 100,000 psi (about 689,476 kPa) without failing or deteriorating to allow liquids or gases to penetrate into or through the plug 150'. In some implementations, the plug 150' is capable of withstanding about 1,000,000 psi (about 6,894,757 kPa) without failing or deteriorating to allow liquids or gases to penetrate into or through the plug 150'. In some implementations, the plug 150' is capable of withstanding about 1,500,000 psi without failing or deteriorating to allow liquids or gases to penetrate into or through the plug 150'. In some implementations, the plug 150' is capable of withstanding about 2,000,000 psi (about 13,789,515 kPa) without failing or deteriorating to allow liquids or gases to penetrate into or through the plug 150'. In some implementations, the plug 150' is capable of withstanding about 2,500,000 psi (about 17,236,893 kPa) without failing or deteriorating to allow liquids or gases to penetrate into or through the plug 150'. In some implementations, the plug 150' is capable of withstanding about 3,000,000 psi (about 20,684,272 kPa) without failing or deteriorating to allow liquids or gases to penetrate into or through the plug 150'. In some implementations, the plug 150' is capable of withstanding about 3,500,000 psi (about 24,131,651 kPa) without failing or deteriorating to allow liquids or gases to penetrate into or through the plug 150'. In some implementations, the plug 150' is capable of withstanding about 4,000,000 psi (about 27,579,029 kPa) without failing or deteriorating to allow liquids or gases to penetrate into or through the plug 150'. In some implementations, the plug 150' is capable of withstanding about 4,500,000 psi without failing or deteriorating to allow liquids or gases to penetrate into or through the plug 150'. In some implementations, the plug 150' is capable of withstanding about 5,000,000 psi (about 34,473,786 kPa) without failing or deteriorating to allow liquids or gases to penetrate into or through the plug 150'.

In some implementations, the plug 150' is capable of withstanding temperatures of about 10° C. to about 225° C.

without failing or deteriorating to allow liquids or gases to penetrate into or through the plug 150'. In some implementations, the plug 150' is capable of withstanding temperatures of about 20° C. to about 205° C. without failing or deteriorating to allow liquids or gases to penetrate into or through the plug 150'. In some implementations, the plug 150' is capable of withstanding temperatures of about 40° C. to about 200° C. without failing or deteriorating to allow liquids or gases to penetrate into or through the plug 150'. In some implementations, the plug 150' is capable of withstanding temperatures of about 60° C. to about 180° C. without failing or deteriorating to allow liquids or gases to penetrate into or through the plug 150'. In some implementations, the plug 150' is capable of withstanding temperatures of about 80° C. to about 160° C. without failing or deteriorating to allow liquids or gases to penetrate into or through the plug 150'. In some implementations, the plug 150' is capable of withstanding temperatures of about 100° C. to about 140° C. without failing or deteriorating to allow liquids or gases to penetrate into or through the plug 150'.

In some implementations, the plug 150' is capable of withstanding temperatures of about 20° C. without failing or deteriorating to allow liquids or gases to penetrate into or through the plug 150'. In some implementations, the plug 150' is capable of withstanding temperatures of about 40° C. without failing or deteriorating to allow liquids or gases to penetrate into or through the plug 150'. In some implementations, the plug 150' is capable of withstanding temperatures of about 60° C. without failing or deteriorating to allow liquids or gases to penetrate into or through the plug 150'. In some implementations, the plug 150' is capable of withstanding temperatures of about 80° C. without failing or deteriorating to allow liquids or gases to penetrate into or through the plug 150'. In some implementations, the plug 150' is capable of withstanding temperatures of about 100° C. without failing or deteriorating to allow liquids or gases to penetrate into or through the plug 150'. In some implementations, the plug 150' is capable of withstanding temperatures of about 120° C. without failing or deteriorating to allow liquids or gases to penetrate into or through the plug 150'. In some implementations, the plug 150' is capable of withstanding temperatures of about 140° C. without failing or deteriorating to allow liquids or gases to penetrate into or through the plug 150'. In some implementations, the plug 150' is capable of withstanding temperatures of about 160° C. without failing or deteriorating to allow liquids or gases to penetrate into or through the plug 150'. In some implementations, the plug 150' is capable of withstanding temperatures of about 180° C. without failing or deteriorating to allow liquids or gases to penetrate into or through the plug 150'. In some implementations, the plug 150' is capable of withstanding temperatures of about 200° C. without failing or deteriorating to allow liquids or gases to penetrate into or through the plug 150'. In some implementations, the plug 150' is capable of withstanding temperatures of about 205° C. without failing or deteriorating to allow liquids or gases to penetrate into or through the plug 150'. In some implementations, the plug 150' is capable of withstanding temperatures of about 225° C. without failing or deteriorating to allow liquids or gases to penetrate into or through the plug 150'.

Analysis of Saudi Arabian Volcanic Ash Sample

Wavelength Dispersive X-ray Fluorescence (WDXRF) was used to conduct elemental analysis. In WDXRF spectrometers, all of the elements in the sample are excited simultaneously. The different energies of the characteristic radiation emitted from the sample are diffracted into different directions by an analyzing crystal or monochrometer (similar to the action of a prism dispersing different colors of visible light into different directions). By placing the detector at a certain angle, the intensity of X-rays with a certain wavelength can be measured. Sequential spectrometers use a moving detector on a goniometer to move it through an angular range to measure the intensities of many different wavelengths. Simultaneous spectrometers are equipped with a set of fixed detection systems, where each system measures the radiation of a specific element.

For the WDXRF analysis, a sample of Saudi Arabian volcanic ash was homogenized and manually grounded by an agate mortar and a pestle for several minutes to achieve fine particle size. 4 grams of the Saudi Arabian volcanic ash powder was then mixed well and homogenized with 0.9 grams of a binder (Licowax C micropowder PM (Hoechstwax)). The powder was then pressed with 20 tons of pressure to a pellet with 31 μmillimeter (mm) diameter. WDXRF analysis was then performed on the sample using the standardless Omnian 27 μmethod. The elemental composition of the sample of Saudi Arabian volcanic ash is shown in Table 1. The WDXRF results (Table 1) show that the sample included mainly oxygen and silicon, with appreciable amounts of aluminum, iron, calcium, magnesium, and sodium.

TABLE 1

WDXRF results of volcanic ash sample

| Element | Weight percent (wt.%) |
|---|---|
| Oxygen (O) | 44.2 |
| Silicon (Si) | 21.8 |
| Aluminum (Al) | 8.5 |
| Iron (Fe) | 8.5 |
| Calcium (Ca) | 6.4 |
| Magnesium (Mg) | 4.2 |
| Sodium (Na) | 3.1 |
| Titanium (Ti) | 1.5 |
| Potassium (K) | 1.0 |
| Phosphorus (P) | 0.3 |
| Manganese (Mn) | 0.1 |

X-ray powder diffraction (XRD) is a rapid analytical technique primarily used for phase identification of a crystalline material and can provide information on unit cell dimensions. The analyzed material is finely ground, homogenized, and average bulk composition can be determined. X-ray diffractometers include three basic elements: an X-ray tube, a sample holder, and an X-ray detector. X-rays are generated in a cathode ray tube by heating a filament to produce electrons, accelerating the electrons toward a target by applying a voltage, and bombarding the target material with electrons. When electrons have sufficient energy to dislodge inner shell electrons of the target material, characteristic X-ray spectra are produced. These spectra consist of several components, the most common being Kα and Kβ. Kα consists, in part, of Kα1 and Kα2. Kα1 has a slightly shorter wavelength and twice the intensity as Kα2. The specific wavelengths are characteristic of the target material (such as copper (Cu), iron (Fe), molybdenum (Mo), and chromium (Cr)). Filtering, by foils or crystal monochrometers, is required to produce the monochromatic X-rays needed for diffraction. Kα1 and Kα2 are sufficiently close in wavelength such that a weighted average of the two is used. These X-rays are collimated and directed onto the sample. As the sample and detector are rotated, the intensity of the reflected X-rays is recorded. A detector records and processes this X-ray signal and converts the signal to a count rate which is then output to a device such as a printer or computer monitor.

For the XRD analysis, a sample of Saudi Arabian volcanic ash was homogenized and manually grounded by an agate mortar and a pestle for several minutes to achieve fine particle size. The average particle size of the ground sample was less than 60 μmicrometers (m). 4 grams of the fine Saudi Arabian volcanic ash powder was then mounted into the XRD sample holder by back pressing. XRD was then performed on the sample using the SALAM 014 μmethod. The composition of the sample of Saudi Arabian volcanic ash is shown in Table 2. The XRD results show that the sample included mainly amorphous material with appreciable amounts of labradorite, augite, and forsterite. The WDXRF results (Table 1) confirmed the XRD results (Table 2).

TABLE 2

XRD results of volcanic ash sample

| Compound | Weight percent (wt. %) |
|---|---|
| Amorphous material | 70 |
| Labradorite: $Ca_{0.65}Na_{0.32}(Al_{1.62}Si_{2.38}O_8)$ | 19 |
| Augite: $Ca(Fe,Mg)Si_2O_6$ | 6 |
| Forsterite: $Mg_2SiO_4$ | 5 |

Table 3 provides non-limiting examples of epoxy resins that can be included in the composition 150. Table 4 provides non-limiting examples of curing agents that can be included in the composition 150.

TABLE 3

Epoxy resin examples

| Epoxy Resin ID | Epoxy Resin Name |
|---|---|
| Resin 1: RAZEEN 2254 | bisphenol-A-epichlorohydrin epoxy resin with the reactive diluent |
| Resin 2 | oxirane mono [(C12-C14)-alkyloxy)methyl] derivatives |
| Resin 3: RAZEEN 7106 | 2,3-epoxypropyl-o-tolyl ether |
| Resin 4 | C12-C14 alkyl glycidyl ether |
| Resin 5: WellLock R1 | 1,6-hexanediol diglycidyl ether |
| Resin 6 | Bisphenol A/Epichlorohydrin resin and butyl glycidyl ether resin |
| Resin 7: WellLock R2 | Bisphenol A/Epichlorohydrin and butyl glycidyl ether and cyclohexanedimethanol resins |
| | Cyclohexanedimethanol diglydicyl ether |

TABLE 4

Curing agent examples

| Curing Agent ID | Composition |
|---|---|
| Curing Agent 1: RAZEEN CURE | 90-100% diethylenetriamine |
| Curing Agent 2: WellLock H1 | Diethyltoluenediamine |
| Curing Agent 3 | Polyoxypropylene diamine |

EXAMPLES

Table 5 provides the composition of Formulation #1. Formulation #1 had a density of 75 pounds per cubic foot ($lb/ft^3$) (1,201.4 kilograms per cubic meter ($kg/m^3$)). Table 6 provides the composition of Formulation #2. Formulation #2 had a density of 73 $lb/ft^3$ (1,169.4 $kg/m^3$).

TABLE 5

Composition of Formulation #1

| Component | Weight percent (wt. %) | Weight (grams, g) |
|---|---|---|
| Resin 1: Resin-2254 | 84.4 | 100 |
| Curing Agent 1: Razeen Cure-931 | 2.1 | 2.5 |
| Volcanic Ash | 13.5 | 16 |

TABLE 6

Composition of Formulation #2

| Component | Weight percent (wt. %) | Weight (grams, g) |
|---|---|---|
| Resin 1: Resin-2254 | 88.1 | 100 |
| Curing Agent 1: Razeen Cure-931 | 3.5 | 4 |
| Volcanic Ash | 8.4 | 9.5 |

The rheology of Formulation #1 was analyzed. The results of the rheology testing (performed at room temperature) of Formulation #1 are provided in Table 7.

TABLE 7

Rheology testing of Formulation #1

| Shear Rate (rpm) | Shear Stress ($dyne/cm^2$) |
|---|---|
| 300 | Out of range |
| 200 | Out of range |

TABLE 7-continued

Rheology testing of Formulation #1

| Shear Rate (rpm) | Shear Stress ($dyne/cm^2$) |
|---|---|
| 100 | 273 |
| 60 | 163 |
| 30 | 82 |
| 6 | 16 |
| 3 | 7 |

Thickening times of Formulations #1 and #2 were analyzed. The results of the thickening time testing (performed visually at room temperature) of Formulations #1 and #2 are provided in Table 8.

TABLE 8

| Thickening times for Formulations #1 and #2 | | |
|---|---|---|
| Test Sample | Time for sample to begin gelling and become viscous/un-pumpable | Thickening time to completely rigid material |
| Formulation #1 | 7 hours | 31 hours |
| Formulation #2 | 4 hours | 7-8 hours |

Embodiments

In an example implementation (or aspect), a method comprises: flowing a lost circulation composition to a lost circulation zone within a wellbore formed in a subterranean formation, wherein the lost circulation composition comprises volcanic ash, an epoxy resin, and a curing agent comprising nitrogen; crosslinking, by the curing agent, the epoxy resin to form a plug at the lost circulation zone in response to exposure to a downhole condition of the lost circulation zone of the wellbore; and preventing, by the plug, fluid from flowing from the wellbore into the subterranean formation through the plug at the lost circulation zone.

In an example implementation (or aspect) combinable with any other example implementation (or aspect), a concentration of the volcanic ash in the composition is in a range of from about 0.1 weight percent (wt. %) to about 50 wt. %.

In an example implementation (or aspect) combinable with any other example implementation (or aspect), a concentration of the epoxy resin is in a range of from about 20 wt. % to about 97 wt. %.

In an example implementation (or aspect) combinable with any other example implementation (or aspect), a concentration of the curing agent is in a range of from about 2 wt. % to about 30 wt. %.

In an example implementation (or aspect) combinable with any other example implementation (or aspect), the epoxy resin has an epoxy value in a range of from 4.5 epoxy equivalents per kilogram of the epoxy resin to 5.5 epoxy equivalents per kilogram of the epoxy resin, wherein the epoxy equivalent is the weight of the epoxy resin in grams that contain one equivalent weight of epoxy, wherein the equivalent weight of epoxy is the molecular weight of the epoxy resin divided by an average number of epoxy groups in the epoxy resin.

In an example implementation (or aspect) combinable with any other example implementation (or aspect), the curing agent has an amine value in a range of from about 250 milligrams of potassium hydroxide per gram (mg KOH/g) to about 1,700 μmg KOH/g, wherein the amine value is a weight of potassium hydroxide in milligrams needed to neutralize one gram of the curing agent.

In an example implementation (or aspect) combinable with any other example implementation (or aspect), the curing agent has an amine hydrogen equivalent weight (AHEW) in a range of from about 20 grams (g) to about 120 g, wherein the AHEW is the molecular weight of the curing agent divided by a number of active hydrogens per molecule of the curing agent.

In an example implementation (or aspect) combinable with any other example implementation (or aspect), the curing agent crosslinks the epoxy resin at the lost circulation zone for a curing time in a range of from about 4 hours to about 12 hours.

In an example implementation (or aspect), a composition, for mitigating lost circulation in a wellbore, comprises: volcanic ash configured to impart (increase) viscosity to the composition; an epoxy resin; and a curing agent comprising nitrogen, wherein the curing agent is configured to crosslink the epoxy resin to form a plug in response to exposure to a downhole condition of the wellbore.

In an example implementation (or aspect) combinable with any other example implementation (or aspect), a concentration of the volcanic ash in the composition is in a range of from about 0.1 weight percent (wt. %) to about 50 wt. %.

In an example implementation (or aspect) combinable with any other example implementation (or aspect), a concentration of the epoxy resin is in a range of from about 20 wt. % to about 97 wt. %.

In an example implementation (or aspect) combinable with any other example implementation (or aspect), a concentration of the curing agent is in a range of from about 2 wt. % to about 30 wt. %.

In an example implementation (or aspect) combinable with any other example implementation (or aspect), the epoxy resin has an epoxy value in a range of from 4.5 epoxy equivalents per kilogram of the epoxy resin to 5.5 epoxy equivalents per kilogram of the epoxy resin, wherein the epoxy equivalent is the weight of the epoxy resin in grams that contain one equivalent weight of epoxy, wherein the equivalent weight of epoxy is the molecular weight of the epoxy resin divided by an average number of epoxy groups in the epoxy resin.

In an example implementation (or aspect) combinable with any other example implementation (or aspect), the curing agent has an amine value in a range of from about 250 milligrams of potassium hydroxide per gram (mg KOH/g) to about 1,700 μmg KOH/g, wherein the amine value is a weight of potassium hydroxide in milligrams needed to neutralize one gram of the curing agent.

In an example implementation (or aspect) combinable with any other example implementation (or aspect), the curing agent has an amine hydrogen equivalent weight (AHEW) in a range of from about 20 grams (g) to about 120 g, wherein the AHEW is the molecular weight of the curing agent divided by a number of active hydrogens per molecule of the curing agent.

In an example implementation (or aspect) combinable with any other example implementation (or aspect), the composition is substantially free of water.

In an example implementation (or aspect), a system comprises: a wellbore formed in a subterranean formation, the wellbore comprising a lost circulation zone; a lost circulation composition comprising: volcanic ash configured to impart viscosity to the lost circulation composition; an epoxy resin; and a curing agent comprising nitrogen; and a pump configured to flow the lost circulation composition to the lost circulation zone of the wellbore, wherein the curing agent is configured to crosslink the epoxy resin to form a plug in response to exposure to a downhole condition of the lost circulation zone of the wellbore, wherein the plug is configured to prevent fluid from flowing from the wellbore into the subterranean formation through the plug at the lost circulation zone.

In an example implementation (or aspect) combinable with any other example implementation (or aspect), the system comprises the plug located at the lost circulation zone.

In an example implementation (or aspect) combinable with any other example implementation (or aspect), a concentration of the volcanic ash in the composition is in a range of from about 0.1 weight percent (wt. %) to about 50 wt. %.

In an example implementation (or aspect) combinable with any other example implementation (or aspect), a concentration of the epoxy resin is in a range of from about 20 wt. % to about 97 wt. %.

In an example implementation (or aspect) combinable with any other example implementation (or aspect), a concentration of the curing agent is in a range of from about 2 wt. % to about 30 wt. %.

In an example implementation (or aspect) combinable with any other example implementation (or aspect), the epoxy resin has an epoxy value in a range of from 4.5 epoxy equivalents per kilogram of the epoxy resin to 5.5 epoxy equivalents per kilogram of the epoxy resin, wherein the epoxy equivalent is the weight of the epoxy resin in grams that contain one equivalent weight of epoxy, wherein the equivalent weight of epoxy is the molecular weight of the epoxy resin divided by an average number of epoxy groups in the epoxy resin.

In an example implementation (or aspect) combinable with any other example implementation (or aspect), the curing agent has an amine value in a range of from about 250 milligrams of potassium hydroxide per gram (mg KOH/g) to about 1,700 μmg KOH/g, wherein the amine value is a weight of potassium hydroxide in milligrams needed to neutralize one gram of the curing agent.

In an example implementation (or aspect) combinable with any other example implementation (or aspect), the curing agent has an amine hydrogen equivalent weight (AHEW) in a range of from about 20 grams (g) to about 120 g, wherein the AHEW is the molecular weight of the curing agent divided by a number of active hydrogens per molecule of the curing agent.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method comprising:

flowing a lost circulation composition to a lost circulation zone within a wellbore formed in a subterranean formation, wherein the lost circulation composition comprises volcanic ash, an epoxy resin, and a curing agent comprising nitrogen wherein the curing agent has an amine value in a range of from about 250 μmilligrams of potassium hydroxide per gram (mg KOH/g) to about 1,700 μmg KOH/g, wherein the amine value is a weight of potassium hydroxide in milligrams needed to neutralize one gram of the curing agent;

crosslinking, by the curing agent, the epoxy resin to form a plug at the lost circulation zone in response to exposure to a downhole condition of the lost circulation zone of the wellbore; and preventing, by the plug, fluid from flowing from the wellbore into the subterranean formation through the plug at the lost circulation zone.

2. The method of claim 1, wherein:

a concentration of the volcanic ash in the composition is in a range of from about 0.1 weight percent (wt. %) to about 50 wt. %;

a concentration of the epoxy resin is in a range of from about 20 wt. % to about 97 wt. %; and a concentration of the curing agent is in a range of from about 2 wt. % to about 30 wt. %.

3. The method of claim 1, wherein the epoxy resin has an epoxy value in a range of from 4.5 epoxy equivalents per kilogram of the epoxy resin to 5.5 epoxy equivalents per kilogram of the epoxy resin, wherein the epoxy equivalent is the weight of the epoxy resin in grams that contain one equivalent weight of epoxy, wherein the equivalent weight of epoxy is the molecular weight of the epoxy resin divided by an average number of epoxy groups in the epoxy resin.

4. The method of claim 1, wherein the curing agent has an amine hydrogen equivalent weight (AHEW) in a range of from about 20 grams (g) to about 120 g, wherein the AHEW is the molecular weight of the curing agent divided by a number of active hydrogens per molecule of the curing agent.

5. The method of claim 1, wherein the curing agent crosslinks the epoxy resin at the lost circulation zone for a curing time in a range of from about 4 hours to about 12 hours.

6. A composition for mitigating lost circulation in a wellbore, the composition comprising:

volcanic ash configured to impart viscosity to the composition;

an epoxy resin; and a curing agent comprising nitrogen, wherein the curing agent has an amine value in a range of from about 250 μmilligrams of potassium hydroxide per gram (mg KOH/g) to about 1,700 mg KOH/g, wherein the amine value is a weight of potassium hydroxide in milligrams needed to neutralize one gram of the curing agent, wherein the curing agent is configured to crosslink the epoxy resin to form a plug in response to exposure to a downhole condition of the wellbore.

7. The composition of claim 6, wherein a concentration of the volcanic ash in the composition is in a range of from about 0.1 weight percent (wt. %) to about 50 wt. %.

8. The composition of claim 6, wherein a concentration of the epoxy resin is in a range of from about 20 weight percent (wt. %) to about 97 wt. %.

9. The composition of claim 6, wherein a concentration of the curing agent is in a range of from about 2 weight percent (wt. %) to about 30 wt. %.

10. The composition of claim 6, wherein the epoxy resin has an epoxy value in a range of from 4.5 epoxy equivalents per kilogram of the epoxy resin to 5.5 epoxy equivalents per kilogram of the epoxy resin, wherein the epoxy equivalent is the weight of the epoxy resin in grams that contain one equivalent weight of epoxy, wherein the equivalent weight of epoxy is the molecular weight of the epoxy resin divided by an average number of epoxy groups in the epoxy resin.

11. The composition of claim 6, wherein the curing agent has an amine hydrogen equivalent weight (AHEW) in a range of from about 20 grams (g) to about 120 g, wherein the AHEW is the molecular weight of the curing agent divided by a number of active hydrogens per molecule of the curing agent.

12. The composition of claim 6, wherein the composition is substantially free of water.

13. A system comprising:

a wellbore formed in a subterranean formation, the wellbore comprising a lost circulation zone;

a lost circulation composition comprising:

volcanic ash configured to impart viscosity to the lost circulation composition;

an epoxy resin; and a curing agent comprising nitrogen, wherein the curing agent has an amine value in a range of from about 250 μmilligrams of potassium hydroxide per gram (mg KOH/g) to about 1,700 μmg KOH/g, wherein the amine value is a weight of potassium hydroxide in milligrams needed to neutralize one gram of the curing agent; and a pump configured to flow the lost circulation composition to the lost circulation zone of the wellbore, wherein the curing agent is configured to crosslink the epoxy resin to form a plug in response to exposure to a downhole condition of the lost circulation zone of the wellbore, wherein the plug is configured to prevent fluid from flowing from the wellbore into the subterranean formation through the plug at the lost circulation zone.

14. The system of claim 13, comprising the plug located at the lost circulation zone.

15. The system of claim 13, wherein:

a concentration of the volcanic ash in the composition is in a range of from about 0.1 weight percent (wt. %) to about 50 wt. %;

a concentration of the epoxy resin is in a range of from about 20 wt. % to about 97 wt. %; and a concentration of the curing agent is in a range of from about 2 wt. % to about 30 wt. %.

16. The system of claim 13, wherein the epoxy resin has an epoxy value in a range of from 4.5 epoxy equivalents per kilogram of the epoxy resin to 5.5 epoxy equivalents per kilogram of the epoxy resin, wherein the epoxy equivalent is the weight of the epoxy resin in grams that contain one equivalent weight of epoxy, wherein the equivalent weight of epoxy is the molecular weight of the epoxy resin divided by an average number of epoxy groups in the epoxy resin.

17. The system of claim 13, wherein the curing agent has an amine hydrogen equivalent weight (AHEW) in a range of from about 20 grams (g) to about 120 g, wherein the AHEW is the molecular weight of the curing agent divided by a number of active hydrogens per molecule of the curing agent.

* * * * *